US005197534A

United States Patent [19]

Gerber et al.

[11] Patent Number: 5,197,534

[45] Date of Patent: Mar. 30, 1993

[54] APPARATUS AND METHOD FOR MAGNETICALLY CONFINING MOLTEN METAL

[75] Inventors: Howard L. Gerber, Park Forest; Richard T. Gass, Chicago, both of Ill.

[73] Assignee: Inland Steel Company

[21] Appl. No.: 902,559

[22] Filed: Jun. 22, 1992

Related U.S. Application Data

[63] Continuation of Ser. No. 739,223, Aug. 1, 1991, abandoned.

[51] Int. Cl.[5] ..... B22D 27/02; B22D 11/06

[52] U.S. Cl. ..... 164/467; 164/480; 164/503; 164/428

[58] Field of Search ..... 164/467, 503, 428, 480

[56] References Cited

U.S. PATENT DOCUMENTS

| | | | |
|---|---|---|---|
| 4,020,890 | 5/1977 | Olsson . | |
| 4,762,653 | 8/1988 | Senillou et al. | 264/10 |
| 4,776,980 | 10/1978 | Ruffini | 252/513 |
| 4,936,374 | 6/1990 | Praeg | 164/503 |
| 4,974,661 | 12/1990 | Lari et al. | 164/503 |
| 4,986,339 | 1/1991 | Miyazawa | 164/466 |

FOREIGN PATENT DOCUMENTS

| | | | |
|---|---|---|---|
| 60-106651 | 6/1985 | Japan | 11/10 |
| 62-104653 | 5/1987 | Japan | 11/6 |

OTHER PUBLICATIONS

J. S. LaMonte and M. R. Black, "How flux field concentrators improve inductor efficiency," *Heat Treating*, Jun. 1989 pp. 30–31.

"Induction Hardening with a Flux Field Concentrator," *Electrical Power Research Institute Technical Application*, vol. 1, No. 11, 1987.

"Guarantee only from Fluxtrol," an advertisement mailed by Fluxtrol of unknown date.

*Primary Examiner*—Kuang Y. Lin

*Attorney, Agent, or Firm*—Marshall, O'Toole, Gerstein, Murray, & Bicknell

[57] ABSTRACT

Molten metal, in the gap between two counter-rotating rolls of a continuous strip-casting apparatus, is prevented from leaking out of an open side of the gap by a magnetic confining apparatus employing the proximity effect to produce a horizontal magnetic field extending through the open side of the gap. The apparatus includes structure for confining the magnetic field substantially to the open side of the gap and for preventing dissipation of the magnetic field away from the open side of the gap.

81 Claims, 9 Drawing Sheets 80
81
82
83
40
41
42
43
44
45
46
47
48
49
50
51
52
57
58
59
61
62
65
66
67
68
96
100
105
106
107
108

230
273
274
275
276
242
250
241
280
266
267
268
257
258
259
245
255
252
243
251

APPARATUS AND METHOD FOR MAGNETICALLY CONFINING MOLTEN METAL

This application is a continuation of application Ser. No. 07/739,223, filed Aug. 1, 1991, now abandoned.

BACKGROUND OF THE INVENTION

The present invention relates generally to apparatuses and methods for magnetically confining molten metal and more particularly to an apparatus and method for preventing the escape of molten metal through the open side of a vertically extending gap between two horizontally spaced members and within which the molten metal is located.

An example of an environment in which the present invention is intended to operate is an arrangement for continuously casting molten metal directly into strip, e.g. steel strip. Such an apparatus typically comprises a pair of horizontally spaced rolls mounted for rotation in opposite rotational senses about respective horizontal axes. The two rolls define a horizontally disposed, vertically extending gap therebetween for receiving the molten metal. The gap defined by the rolls tapers in a downward direction. The rolls are cooled, and in turn cool the molten metal as the molten metal descends through the gap.

The gap has horizontally spaced, open opposite ends adjacent the ends of the two rolls. The molten metal is unconfined by the rolls at the open ends of the gap. To prevent molten metal from escaping outwardly through the open ends of the gap, mechanical dams or seals have been employed.

Mechanical dams have drawbacks because the dam is in physical contact with both the rotating rolls and the molten metal. As a result, the dam is subject to wear, leaking and breakage and can cause freezing and large thermal gradients in the molten metal. Moreover, contact between the mechanical dam and the solidifying metal can cause irregularities along the edges of metal strip cast in this manner, thereby offsetting the advantages of continuous casting over the conventional method of rolling metal strip from a thicker, solid entity.

The advantages obtained from the continuous casting of metal strip, and the disadvantages arising from the use of mechanical dams or seals are described in more detail in Praeg U.S. Pat. No. 4,936,374 and in Lari et al U.S. Pat. No. 4,974,661, and the disclosures of each of these patents are incorporated herein by reference.

To overcome the disadvantages inherent in the employment of mechanical dams or seals, efforts have been made to contain the molten metal at the open end of the gap between the rolls by employing an electromagnet having a core encircled by a conductive coil through which an alternating electric current flows and having a pair of magnet poles located adjacent the open end of the gap. The magnet is energized by the flow of alternating current through the coil, and the magnet generates an alternating or time-varying magnetic field extending across the open end of the gap between the poles of the magnet. The magnetic field can be either horizontally disposed or vertically disposed, depending upon the disposition of the poles of the magnet. Examples of magnets which produce a horizontal field are described in the aforementioned Praeg U.S. Pat. No. 4,936,374; and examples of magnets which produce a vertical magnetic field are described in the aforementioned Lari et al U.S. Pat. No. 4,974,661.

The alternating magnetic field induces eddy currents in the molten metal adjacent the open end of the gap, creating a repulsive force which urges the molten metal away from the magnetic field generated by the magnet and thus away from the open end of the gap.

The static pressure force urging the molten metal outwardly through the open end of the gap between the rolls increases with increased depth of the molten metal, and the magnetic pressure exerted by the alternating magnetic field must be sufficient to counter the maximum outward pressure exerted on the molten metal. A more detailed discussion of the considerations described in the preceding sentence and of the various parameters involved in those considerations are contained in the aforementioned Praeg and Lari et al. U.S. Patents.

Another expedient for containing molten metal at the open end of a gap between a pair of members is to locate, adjacent the open end of the gap, a coil through which an alternating current flows. This causes the coil to generate a magnetic field which induces eddy currents in the molten metal adjacent the open end of the gap resulting in a repulsive force similar to that described above in connection with the magnetic field generated by an electromagnet. Embodiments of this type of expedient are described in Olsson U.S. Pat. No. 4,020,890, and the disclosure therein is incorporated herein by reference.

The use of a coil to directly generate the magnetic field adjacent the open end of the gap is more efficient than the use of an electromagnet because, when employing an electromagnet, the coil is used to energize the core of a magnet through which magnetic flux must travel to the magnet poles which then generate a magnetic field adjacent the open end of the gap. As a result, there is so-called "core loss" when a coil is employed to energize an electromagnet; but core loss is not a significant factor when the coil is employed to directly generate the magnetic field at the open end of the gap.

A drawback to the latter expedient is that the coil must be placed quite close to the open end of the gap in order to generate a magnetic field which will contain the molten metal there. In the expedient employing an electromagnet, the coil can be relatively remote from the open end of the gap. The closer the coil is to the molten steel, the more severe the thermal conditions to which the coil is subjected. Another drawback to the expedient employing a coil for directly generating the magnetic field at the open end of the gap is that part of the magnetic field is radiated in a direction away from the open end of the gap, thereby decreasing the efficiency of the coil. The problem described in the preceding sentence can also be a problem when employing any electromagnet.

SUMMARY OF THE INVENTION

The drawbacks and deficiencies of the prior art expedients described above are eliminated by an apparatus and method in accordance with the present invention.

A magnetic confining method and apparatus in accordance with the present invention employs the proximity effect to directly generate, adjacent the open side of the gap, a horizontal magnetic field which extends through the open side of the gap to the molten metal in the gap and the magnetic field is confined substantially to the open side of the gap. The horizontal magnetic field is directly generated by a coil located adjacent the open side of the gap, with a surface portion of the coil facing the open side of the gap. Typically, alternating current is conducted through the coil to generate the horizontal magnetic field which extends from the facing surface portion of the coil, through the open side of the gap, to the molten metal.

Employment of the proximity effect requires that the coil be located sufficiently close to the open side of the gap so that the strength (H) of the magnetic field, at the open side of the gap, is sufficient to offset the pressures which urge the molten metal outwardly through the open side of the gap. The strength of the magnetic field generated by the coil decreases with increasing distance of the coil from the open side of the gap. The electromagnetic pressure between two conducting surfaces (in this case the coil and the molten metal) is directly proportional to the square of the magnetic field strength ($H^2$).

The coil and its associated structure are located sufficiently close to the open side of the gap to contain the molten metal within the gap, and the possible adverse effects of such close proximity are offset by the employment of structure, to be described below in detail, which protects the coil.

Dissipation of the magnetic field in a direction away from the open side of the gap is prevented by restricting the magnetic field generated by the coil substantially to the open side of the gap. This is accomplished, in part, by providing a non-magnetic electrical conductor (1) which is in electrically conductive relation with the coil (2) which faces the open side of the gap, and (3) which is sufficiently proximate to the open side of the gap to confine the magnetic field substantially to the open side of the gap. The coil has upper and lower portions, and the conductor occupies substantially the entire area between the coil's upper and lower portions. In addition, there is structure, composed of magnetic material, which (a) concentrates the flow of electric current in the surface portion of the coil which faces the open side of the gap and (b) provides a low reluctance return path for the directly generated magnetic field which extends through the open side of the gap.

The non-magnetic conductor is configured to conform to the tapered shape of the gap so as to increase the magnetic pressure against the molten metal, in accordance with increasing static pressure (i.e. depth) of the molten metal in the gap. In some embodiments, the conductor and the surface portion of the coil facing the open side of the gap coincide, i.e. they are one and the same.

Other features and advantages are inherent in the method and apparatus claimed and disclosed or will become apparent to those skilled in the art from the following detailed description in conjunction with the accompanying drawings.

DETAILED DESCRIPTION

Figure 1:
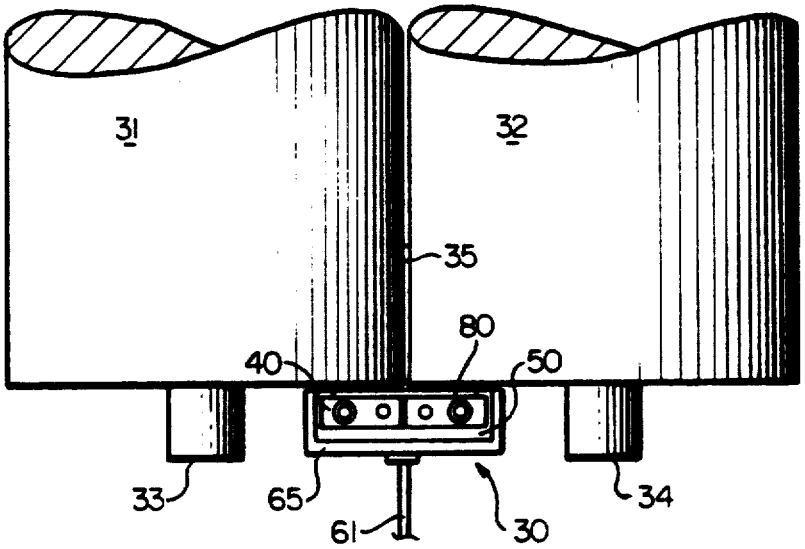
FIG. 1 is a plan view showing an embodiment of an apparatus in accordance with the present invention, associated with a pair of rolls of a continuous strip caster.
Figure 2:
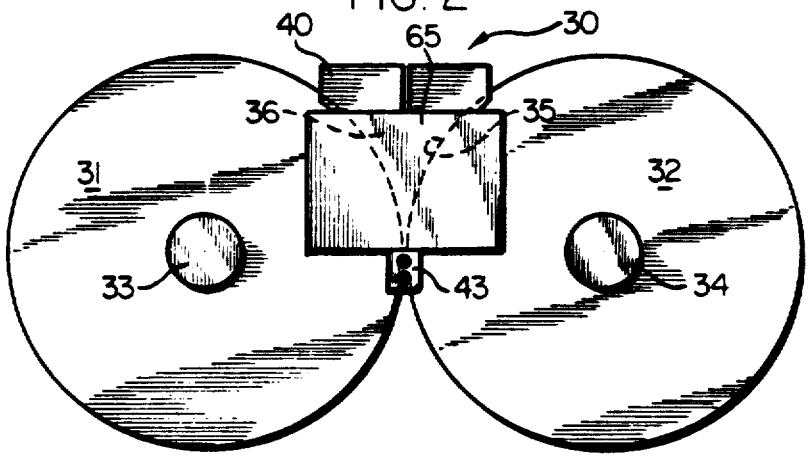
FIG. 2 is an end view of the apparatus and rolls of FIG. 1.

Referring initially to FIGS. 1-3, 12 and 13, indicated generally at 30 is a magnetic confining apparatus constructed in accordance with an embodiment of the present invention. Apparatus 30 employs the proximity effect to prevent the escape of molten metal through the open side 36 of a vertically extending gap 35 located between two horizontally spaced, metal rolls 31, 32 in a continuous strip caster. Rolls 31, 32 rotate in respective opposite, rotative senses about respective axes 33, 34. Molten metal is normally contained in gap 35. Rolls 31, 32 are cooled, in a conventional manner not disclosed here, and as molten metal descends vertically through gap 35, the metal is cooled and solidified into a metal strip 37 (FIG. 12) descending downwardly from the narrowest part of gap 35.

But for apparatus 30, molten metal in gap 35 would escape through open side 36 of gap 35. Although only one open side of gap 35, and one apparatus 30 is shown in the figures, it should be understood that there is an open side at each open end of gap 35 and an apparatus 30 at each open end.

Apparatus 30 comprises a current-conducting coil 40 located adjacent open side 36 of gap 35 and having a coil surface portion facing open side 36. Alternating current is conducted through coil 40, in a manner to be subsequently described, and this directly generates a horizontal magnetic field which, because of the proximity of coil 40 to open side 36, is caused to extend from the facing side of the coil, through open side 36 of gap 35, to the molten metal in the gap. Coil 40 is sufficiently proximate open side 36 so that the directly generated horizontal magnetic field has a strength sufficient to exert a confining pressure against the molten metal in gap 35.

Apparatus 30 comprises structure, to be described in detail later, for preventing the magnetic field from dissipating in a direction away from open side 36 of gap 35. This structure confines the magnetic field generated by the coil substantially to the open side 36 of the gap.

Figures 4, 5:
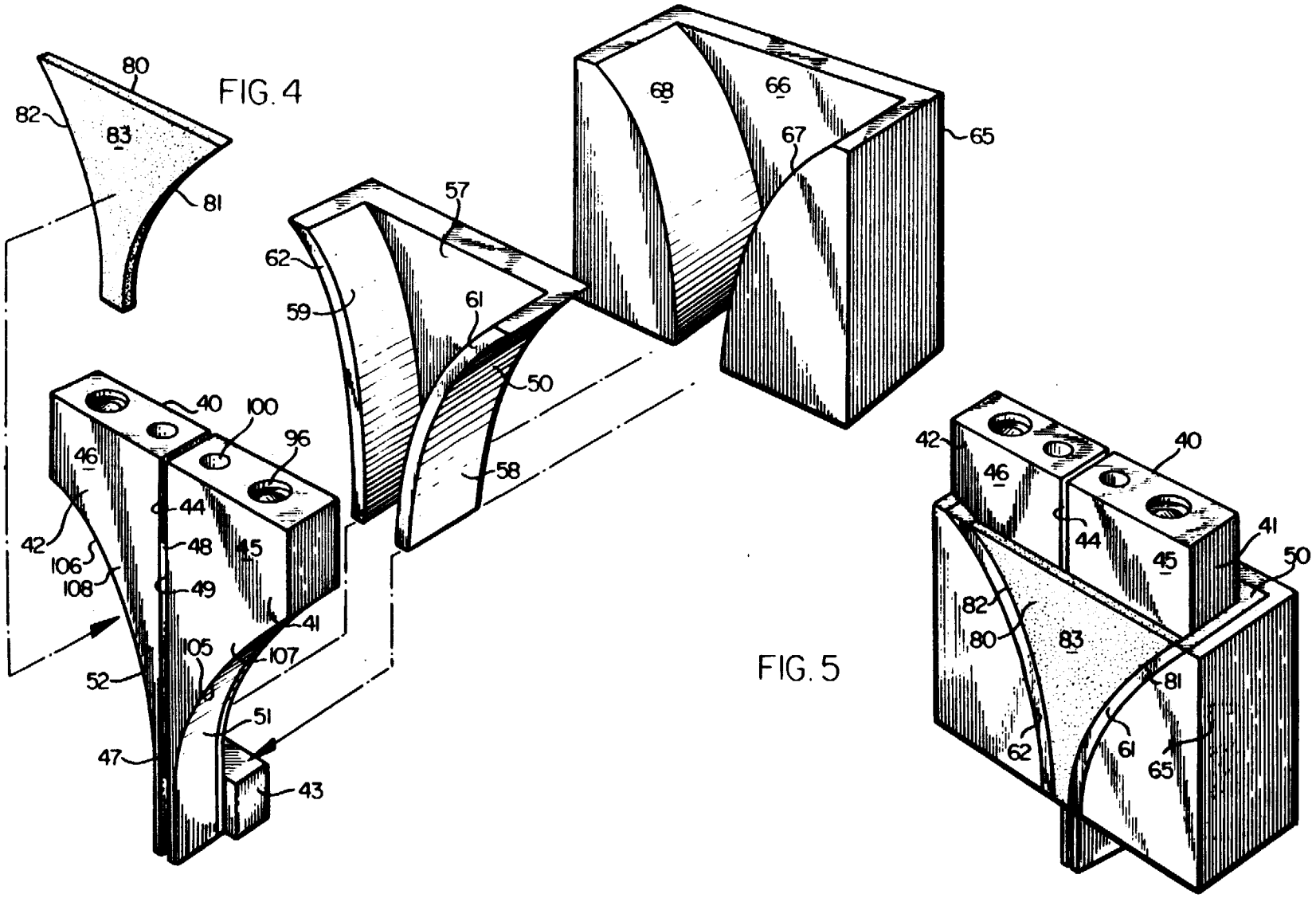
FIG. 4 is an exploded perspective of the apparatus.
FIG. 5 is a perspective of the apparatus with all the components thereof assembled together.
Figure 6:
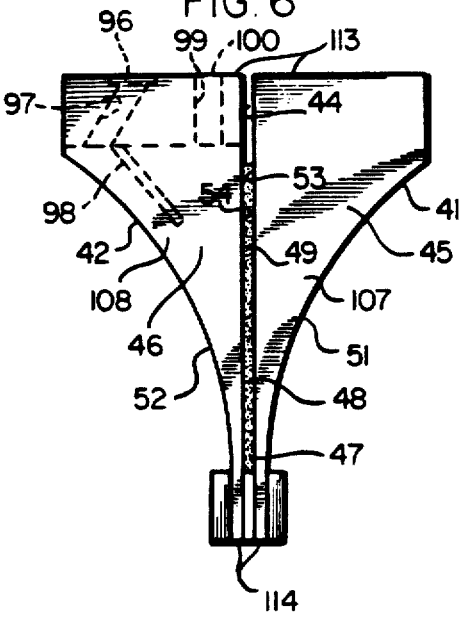
FIG. 6 is a front end view of a single-turn coil constituting one component of the apparatus.
Figure 7:
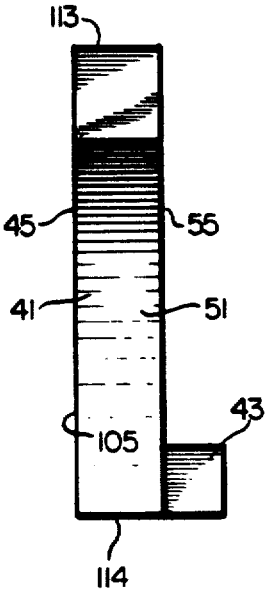
FIG. 7 is a side view of the coil of FIG. 6.
Figure 8:
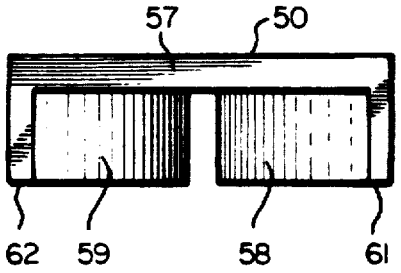
FIG. 8 is a plan view of a magnetic cover constituting another component of the apparatus.

Referring now to FIGS. 4–5, coil 40 comprises a single turn which faces the open side 36 of gap 35. Coil 40 comprises a pair of half coils 41, 42 separated by a narrow vertical space 44 and conductively joined adjacent an end of each by a connecting element 43 located at the bottom of coil 40. Each half coil 41, 42 is vertically disposed and has a respective vertically disposed front wall 45, 46 facing open side 36 of gap 35. The two front walls 45, 46 together constitute a non-magnetic, electrical conductor which (a) is in electrically conductive relation with coil 40 and (b) faces open side 36 of gap 35 and (c) is sufficiently proximate to open side 36 to confine the magnetic field, generated by coil 40, substantially to open side 36. As shown in FIG. 6, the conductor defined by front walls 45, 46 occupies substantially the entire area between top and bottom portions 113, 114 of coil 40, except for narrow vertical space 44.

Figure 12:
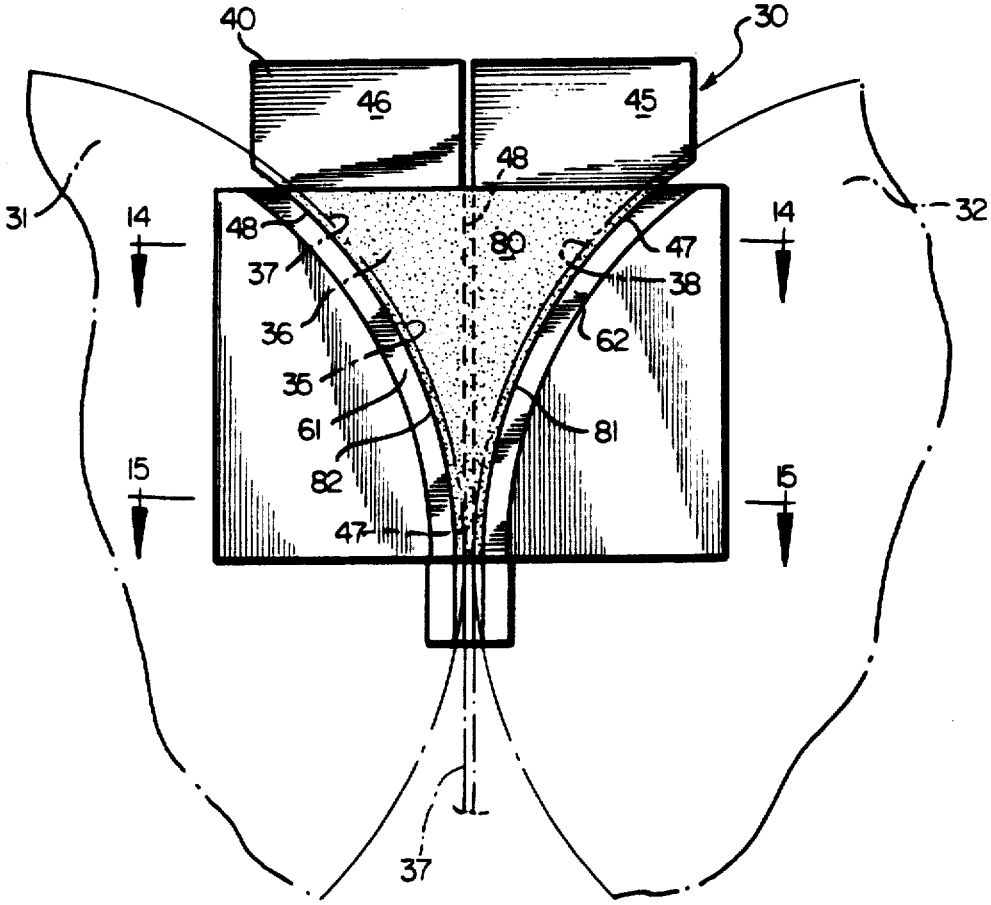
FIG. 12 is an enlarged front end view of the apparatus.

Each front wall 45, 46 of a half coil 41, 42 has a width which narrows downwardly along the vertical dimension of the half coil in conformity with a narrowing in the width of open side 36 of gap 35 (FIGS. 4, 6 and 12). In other words, the conductor defined by front walls 45, 46 has a shape conforming substantially to the tapering shape of open side 36 of gap 35. The current density and magnetic field intensity in a front wall 45, 46 is determined by the total current across the wall divided by the width of the wall. As the width decreases, the current density and magnetic field intensity increase. Accordingly, when current of a given magnitude flows through coil 40, the current density in front walls 45, 46 increases in a downward direction with decreasing width of the front walls. The static pressure developed by the molten metal in gap 35 increases with increased depth. However, increased current density produces increased magnetic field intensity and increased magnetic pressure. As a result, the configuration of the conductor defined by front walls 45, 46 brings about an increase in the magnetic pressure associated with the magnetic field generated by coil 40, thereby offsetting the increased static pressure developed by the molten metal in gap 35.

The conductor defined by front wall 45, 46 is shown in the figures as having an arcuately tapered, downwardly converging shape. A triangular, straight line, downwardly converging shape could also be employed.

Figure 14:
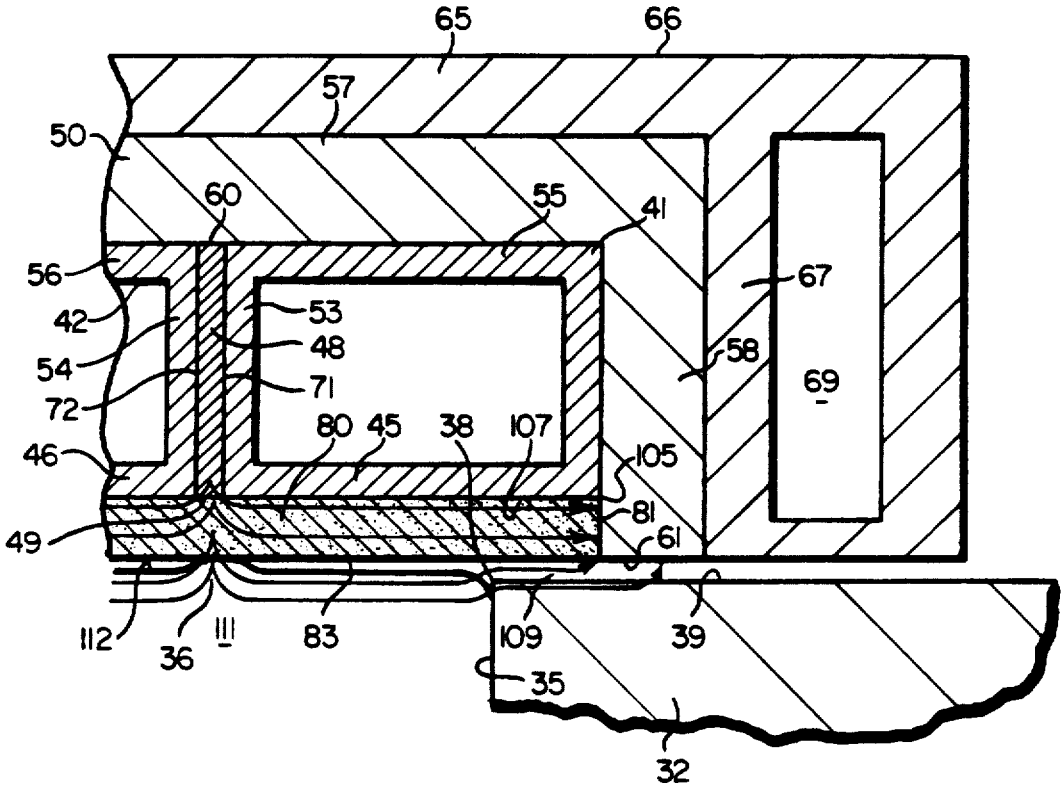
FIG. 14 is an enlarged, fragmentary, sectional view, taken along line 14—14 in FIG. 12, showing the magnetic field generated by the apparatus, near the top of the gap between the rolls.

Each half coil 41, 42 has, in addition to respective front walls 45, 46, respective outside walls 51, 52, respective inside walls 53, 54 and respective rear walls 55, 56 (FIG. 14).

Associated with coil 40 are a pair of members composed of magnetic material, cooperating to concentrate the current which flows through coil 40 in coil front walls 45, 46 and to produce a low reluctance return path for the magnetic field produced by coil 40 and which extends through open side 36 of gap 35. There is a vertically disposed, substantially planar, first magnetic member 48 (FIGS. 14–15) which (a) lies in a plane parallel to the axis of rolls 31, 32 and (b) has a vertically disposed half coil 41, 42 is located adjacent a respective opposite side surface 71, 72 of first magnetic member 48 and is electrically insulated therefrom by a thin layer of electrical insulating material (not shown). First magnetic member 48 has a front edge 49 facing open side 36 of gap 35 in substantially the sam close proximity thereto as the front walls 45, 46 of half coils 41, 42. First magnetic member 48 also has a rear edge 60 in substantially abutting relation with rear wall 57 of a second magnetic member 50.

Figure 13:
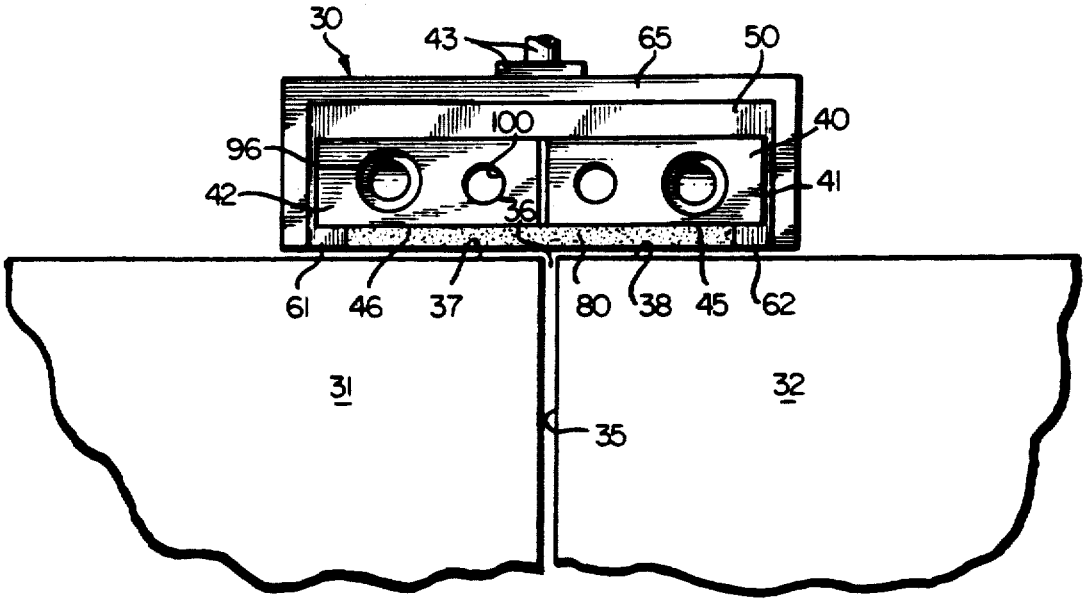
FIG. 13 is an enlarged plan view of the apparatus.

Second magnetic member 50 partially encloses coil 40. More particularly, second magnetic member 50 has a rear wall 57 enclosing the rear walls 55, 56 of the two half coils 41, 42 and electrically insulated therefrom by a thin layer of electrical insulating material (not shown). Second magnetic member 50 also has a pair of spaced apart side walls 58, 59 each enclosing and closely following the contour of a respective outside wall 51, 52 of a respective half coil 41, 42 and electrically insulated therefrom by a thin layer of electrical insulating material (not shown). Each side wall 58, 59 of second magnetic member 50 has a front end 61, 62 (FIGS. 4–5) facing a respective rotatable roll 31, 32 adjacent a peripheral side edge 37, 38 of the roll (FIGS. 12–13).

First magnetic member 48 and second magnetic member 50 comprise structure cooperating to provide a low reluctance return path for the directly generated magnetic field which extends through open side 36 of gap 35 by coil 40.

In addition to the components described above, apparatus 30 also comprises a shield 65 composed of non-magnetic, conductive material. Shield 65 partially encloses second magnetic member 50, in a manner to be described below, and prevents a magnetic field from forming around the outside of and behind second magnetic member 50. In other words, shield 65 confines that part of the directly generated magnetic field which is outside of the low reluctance return path to substantially a space defined on one side by the coil's front walls 45, 46 and on the other side by the molten metal in gap 35.

Shield 65 comprises a rear wall portion 66, enclosing rear wall 57 of second magnetic member 50 from behind and electrically insulated therefrom by a thin layer of electrical insulating material (not shown). Shield 65 also includes a pair of side wall portions 67, 68 each enclosing a respective side wall 58, 59 of second magnetic member 50 from the outside and electrically insulated therefrom by a thin layer of electrical insulating material (not shown).

Each side wall portion 67, 68 of shield 65 has an inner surface which (a) is in close proximate relation to the adjacent side wall 58, 59 of second magnetic member 50 and (b) follows the contour of the adjacent side wall. Rear wall portion 66 of shield 65 has an inner surface in close proximate relation to rear wall 57 of second magnetic member 50.

Figure 11:
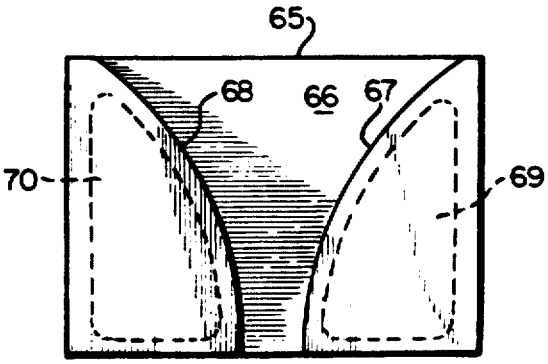
FIG. 11 is a front end view of the conductive shield of FIG. 10.

Shield 65 has a hollow interior, shown at 69, 70 in FIG. 11, defining a passage through which a cooling fluid can be circulated through inlet and outlet openings (not shown).

Referring now to FIGS. 4–5 and 14–15, apparatus 30 further comprises a refractory member 80 covering the front edge 49 of first magnetic member 48 and also covering front walls 45, 46 of half coils 41, 42. Refractory member 80 has a pair of opposed side edges 81, 82 each abutting against a respective side wall 58, 59 of second magnetic member 50. Refractory member 80 also has a vertically disposed outside surface 83 which lies in substantially the same vertical plane as front ends 61, 62 of sidewalls 58, 59 on second magnetic member 50.

Refractory member 80 covers that part of coil front walls 45, 46 otherwise exposed to the molten metal in gap 35. In the illustrated embodiment, refractory member 80 does not cover front ends 61, 62 of side walls 58, 59 on second magnetic member 50.

As noted above, first magnetic member 48 is electrically insulated from the two half coils 45, 46, and second magnetic member 50 is electrically insulated from half coils 45, 46 and shield 65. To perform the insulating function, one may employ a commercially available, electrical insulating tape which can be wrapped around magnetic members 48 and 50. The tape should be a temperature-resistant, insulating film capable of withstanding temperatures up to 177° C. (350° F.) with a maximum film thickness of about 0.127 mm (0.005 in.).

Coil 40 is composed of a highly conductive material such as copper or copper base alloy. Each half coil 41, 42 has a hollow interior defining a passage through which a cooling fluid may be circulated, and this will be described subsequently in greater detail.

As shown in FIG. 12, first magnetic member 48 has a lower portion 47 at substantially the same vertical level as the narrowest part of open side 36 of gap 35. Lower portion 47 is composed of a plurality of laminated, horizontally disposed, vertically layered strips of grain oriented silicon steel, a conventional magnetic material. The upper portion of first magnetic member 48 may be composed of the same material, although the layered strips of silicon steel need not be horizontally disposed but may be vertically disposed.

Horizontally disposed silicon steel strips are employed at the lower portion 47 of first magnetic member 48 because they produce less core loss than do vertically disposed strips. Neither ferrite nor powdered iron should be used for lower portion 47 of first magnetic member 48 because the saturation levels of these two materials are much less than the saturation levels of grain oriented silicon steel. However, ferrite and powdered iron may be used at the uppermost portion of the magnetic member where the magnetic field density and resultant flux density, which increase with increased depth of the molten metal, are relatively low and can be handled by materials having relatively low saturation levels. Where the depth of the molten metal is at a maximum, magnetic field density and resultant flux density are at a maximum and require the use of a material having a relatively high saturation level, namely, grain oriented silicon steel.

Second magnetic member 50 may be composed of any material heretofore conventionally employed as a magnetic material in electromagnets. In addition to laminated strips of silicon steel, second magnetic member 50 may be composed of compacted ferrite powder or compacted iron powder, for example. If laminated strips of silicon steel are employed on second magnetic member 50, the laminations may be either horizontally disposed or vertically disposed, the latter being preferable.

Refractory member 80 is composed of a ceramic material such as boron nitride or a material known as "Duraboard" TM 3000 or 3300, a low density alumina material made by Carborundum Corp. The ceramic material of which refractory member 80 is composed must have sufficient temperature resistance to protect coil 40 if there is a current failure causing a cessation of the magnetic field. In such a case, of course, the molten metal in gap 35 would be urged outwardly through open side 36 of the gap toward coil 40. Refractory member 80 protects coil 40, should that occur. Refractory member 80 is wedged between front ends 61, 62 of second magnetic member 50 and is adhered to front walls 45, 46 of half coils 41, 42 employing a high temperature epoxy cement, for example.

Rolls 31, 32 are preferably made of a highly conductive copper base alloy composed primarily of oxygen free copper and may contain small amounts of silver (0.07–0.12 wt. %) and phosphorous (about 0.02 wt. %), for scratch resistance.

To position coil 40 as close as possible to open end 36 of gap 35, apparatus 30 preferably substantially abuts against the ends of rolls 31, 32, with only a very slight space or clearance between apparatus 30 and rolls 31, 32.

Figure 24:
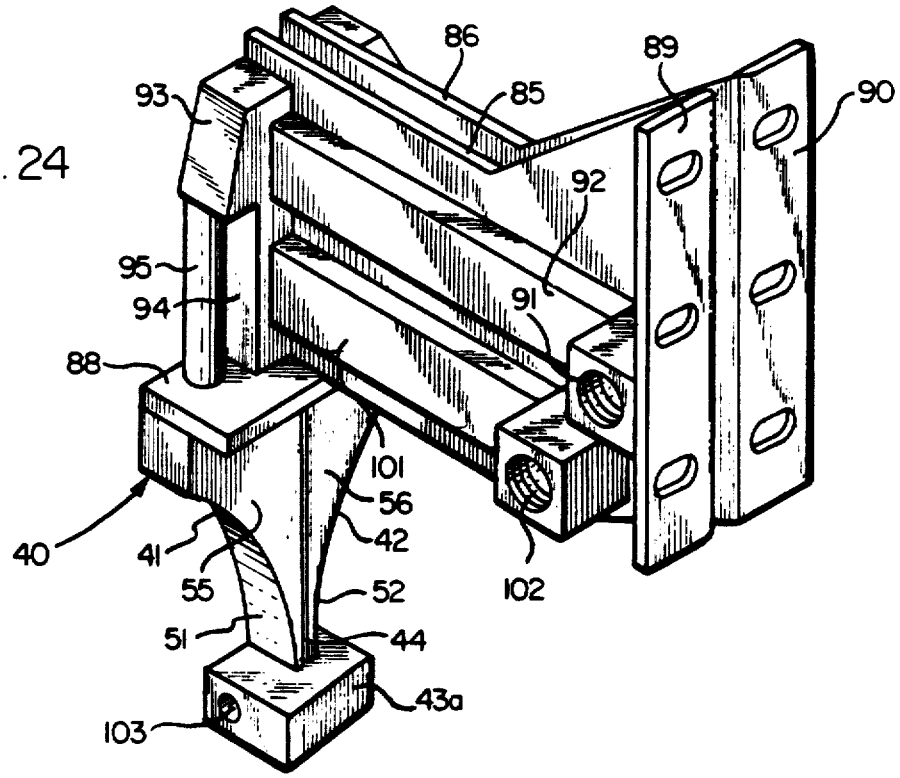
FIG. 24 is a perspective of the embodiment of FIG. 1 in association with bus bars and cooling conduits.

Apparatus 30 is supported in the desired positional relationship with rolls 31, 32 by structure, illustrated in FIG. 24, which also functions as bus bars for conducting electric current to coil 40 and provides conduits for circulating cooling fluid into and out of coil 40.

As shown in FIG. 24, located above coil 40 are a pair of metal conductive members 85, 86 connected electrically and structurally to half coils 41, 42 respectively. At an end of each member 85, 86, remote from coil 40, is a respective flange 89, 90 which is (a) mechanically connected to supporting structure (not shown) and (b) electrically connected to a source of alternating current (not shown). Mechanically and electrically connecting member 85 to half coil 41 is a conductive metal plate 88 resting atop half coil 41. The mechanical connection of plate 88 to half coil 41 employs conventional metal mechanical fasteners. A plate similar to 88 connects member 86 to half coil 42. That plate is not shown in FIG. 24, but it is horizontally spaced away from plate 88 which connects member 85 to half coil 41. Members 85 and 86 are similarly horizontally spaced apart. Members 85, 86 and plate 88 may be composed of the same material as coil 40.

Current is conducted through member 85 and plate 88 to half coil 41, then through connecting element 43*a* and half coil 42 to the plate (not shown) atop half coil 42 and then through member 86. Connecting element 43*a* in FIG. 24 is located below coil 40 rather than to the rear of coil 40 as is connecting element 43 in FIGS. 4–7.

Member 86 is a mirror image of member 85, and half coil 42 is a mirror image of half coil 41. The following discussion will be in connection with member 85, but member 86 has similar features which are mirror images of those in member 85.

Extending alongside member 85 is an integral inlet conduit 92 which communicates with a distributor upper portion 93 separated from a distributor lower portion 94 by a horizontally disposed internal partition not shown in FIG. 24. Distributor upper portion 93 communicates with a vertical conduit 95 which communicates with an inlet opening 96 in the top of a half coil (FIG. 6).

Inlet opening 96 communicates with an inclined inlet passage 97 which introduces cooling fluid into the interior of a half coil. An inclined guide member 98 in the interior of the half coil directs incoming fluid initially along one side of the interior of the half coil and then along the other side. Cooling fluid circulates through the half coil and is withdrawn therefrom through a vertically disposed outlet passage 99 communicating with an outlet opening 100 communicating with lower distributor portion 94 which in turn communicates with an outlet conduit 101 disposed along the side of member 85. Although, in FIG. 6, elements 96–100 are shown in association with half coil 41, the same elements would be present in half coil 42 as mirror images.

Cooling fluid is introduced into inlet conduit 92 on member 85 through an inlet fitting 91, connected to a source of cooling fluid (not shown), and cooling fluid is withdrawn from outlet conduit 101 through an outlet fitting 102.

The cooling fluids circulated through coil 40 should be high purity, low conductivity cooling water, for example.

Figure 3:
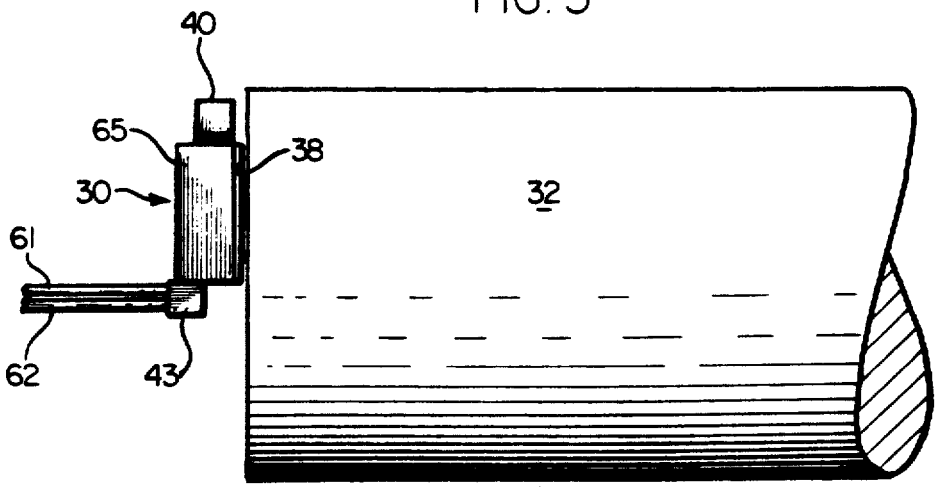
FIG. 3 is a side view of the apparatus and rolls.

The cooling fluid circulated through connecting element 43 on coil 40 (FIGS. 2–7) is separate from the cooling fluid circulated through each half coil 41, 42. Cooling fluid is introduced into and withdrawn from connecting element 43 via inlet and outlet conduits 61, 62 respectively (FIGS. 1 and 3). Similarly, the cooling fluid circulated through connecting element 43*a* in the embodiment of FIG. 24 is separate from the cooling fluid circulated through each half coil 41, 42. In the embodiment of FIG. 24, cooling fluid is introduced into connecting element 43*a* through an inlet 103 and is removed from connecting element 43*a* through an outlet opening (not shown) on the opposite side of connecting element 43*a* from inlet 103.

In the embodiment of FIG. 24, current enters and leaves half coils 41, 42 via members 85, 86 located at the top of coil 40. In an alternative embodiment, bus bars can be located at the bottom of each half coil 41, 42 rather than at the top. In such an alternative embodiment, connecting element 43 or 43*a* would be located at the top of the coil rather than at the bottom.

As noted above, side wall portions 67, 68 of shield 65 have an interior surface which conforms to and closely follows the exterior surface of side walls 58, 59 on second magnetic member 50 (FIG. 5). Cooling fluid is circulated through the hollow interior 69, 70 of shield 65 (FIG. 11) to cool the shield and to assist in cooling second magnetic member 50.

Figure 9:
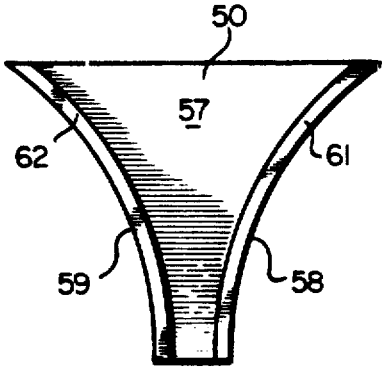
FIG. 9 is a front end view of the magnetic cover of FIG. 8.
Figure 10:
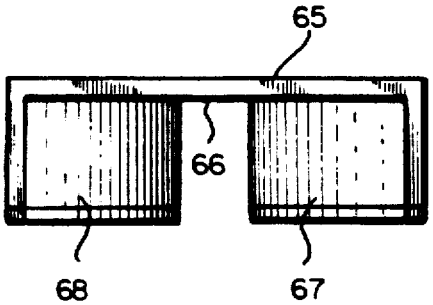
FIG. 10 is a plan view of a conductive shield constituting still another component of the apparatus.

Although side wall portions 67, 68 on shield 65 are shown with vertical exterior surfaces (FIGS. 4, 11), these exterior surfaces may curve inwardly from top to bottom just as do the interior surfaces of side wall portions 67, 68. In such a case, the shape of shield 65 would resemble the shape of second magnetic member 50 (FIGS. 4, 9). However, no matter the embodiment employed for shield 65, it is important that the inner surfaces of sidewall portions 67, 68 conform to and closely follow the outer surfaces of sidewalls 58, 59 of second magnetic member 50 and that the inside surfaces of side walls 58, 59 on second magnetic member 50 conform to and closely follow the outside surfaces of outside walls 51, 52 on half coils 41, 42.

Figure 15:
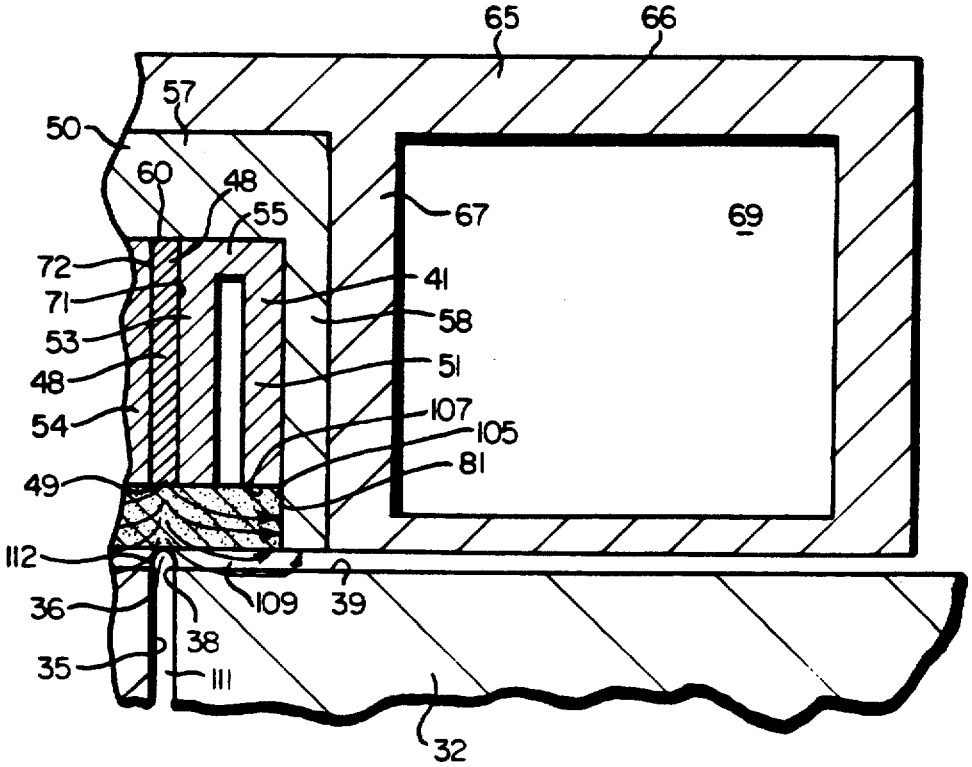
FIG. 15 is a sectional view, taken along line 15—15 in FIG. 12, showing the magnetic field generated by the apparatus near the bottom of the gap.

Referring now to FIGS. 14 and 15, these figures show, with arrows, the magnetic field generated by coil 40 at upper and lower elevations indicated by section lines 14—14 and 15—15 respectively in FIG. 12. The magnetic field enters and leaves magnetic members such as 48 and 50 at right angles to a surface of the magnetic material. The magnetic field generally is parallel or tangent to a surface composed of non-magnetic, conductive material, such as front wall 45 of coil 40 and rolls 31, 32. Refractory member 80 is essentially transparent to the magnetic field. The molten metal confined in gap 35 is shown at 111 in FIGS. 14 and 15, and the outer boundary of molten metal 111 at open side 36 of gap 35 is shown at 112 in FIGS. 14 and 15.

As noted above, each roll 31, 32 has a peripheral side edge 37, 38 defining an edge of open side 36 of gap 35. Adjacent each side edge 37, 38 is a side edge portion, e.g. side edge portion 39 adjacent peripheral side edge 38 (FIGS. 14–15). Similarly, each front wall 45–46 on a half coil 41, 42, has a respective outside edge 105, 106, each horizontally spaced from the other, and there is an outside edge portion 107, 108 adjacent each outside edge 105, 106 respectively.

As shown in FIG. 12, the horizontal distance between outside edges 105, 106 on half coil front walls 45, 46 is greater than the horizontal distance between the two peripheral side edges 37, 38 defining open side 36 of gap 35, at the same vertical location along gap 35. Referring to FIGS. 14–15, each outside edge portion 107, 108 on a respective coil front wall 45, 46 is spaced in an axial direction away from a respective side edge portion, e.g. 39 on roll 32, to define a narrow space 109 therebetween.

As shown in FIGS. 14 and 15, outside edge portion 107 on front wall 45 of half coil 41 and side edge portion 39 on roll 32 cooperate to provide increased magnetic flux density in the magnetic field in space 109, compared to the flux density of the magnetic field extending across open side 36 of gap 35. The reason for this will be discussed below. Increased magnetic flux density increases the magnetic pressure in space 109, compared to the magnetic pressure at open side 36 of gap 35, thereby preventing molten metal from flowing laterally outwardly through space 109.

The depth of penetration of a magnetic field into a non-magnetic conductor, such as molten metal 111 or front wall 45 of half coil 41 or roll 32, is inversely proportional as the square root of the product of (a) the magnetic permeability and (b) the conductivity of the conductive material. Copper or copper alloy, of which half coil front wall 45 and roll 32 are composed, are much less penetrable by a magnetic field than is molten steel. As a result, the magnetic field and magnetic flux density are more concentrated in space 109, between peripheral edge portion 39 on roll 32 and outside edge portion 107 on half coil front wall 45, than between front wall 45 and outside boundary 112 on molten metal 111, when the molten metal is steel.

The magnetic pressure developed by the magnetic field is proportional to the square of the magnetic flux density which in turn is determined by the cross-sectional area of the magnetic flux. Because the magnetic field is squeezed in space 109, the cross-sectional area of the magnetic flux in space 109 is smaller than the cross-sectional area of the flux in the space between coil 40 and molten metal 111. As a result, the magnetic flux density is increased in space 109, compared to the magnetic flux density between coil 40 and molten metal 111, thereby increasing the magnetic pressure in space 109 compared to the magnetic pressure between coil 40 and molten metal 111.

The depth of penetration of the magnetic field is also inversely proportional to the angular frequency of the alternating electric current. At a frequency of 3,000 Hertz, the relative penetrations of the magnetic field into molten steel and copper is about 10.9 and 1.2 mm, respectively. A typical operating frequency for coil 40 is about 3,000 Hertz. If the frequency is too much lower than that, secondary re-circulating flows can be developed in the molten metal, and that would be undesirable. The higher the frequency, the greater the amount of heat that is generated in the coil, and that in turn requires increased cooling. The frequency employed cannot be greater than the available cooling capacity.

The magnetic pressure directly opposite front edge 49 on first magnetic member 48 is less than the magnetic pressure elsewhere along open side 36 of gap 35, because of the directionality of the magnetic field opposite front edge 49 (FIG. 14). As a result, molten metal boundary 112 projects further outwardly toward coil 40 at a location directly opposite first magnetic member 48.

The smaller the width of first magnetic member 48, the less spreading the magnetic field will undergo directly in front of first magnetic member 48, producing a smaller decrease in magnetic pressure there. If first magnetic member 48 is relatively wide, molten metal 111 may touch refractory member 80 in front of first magnetic member 48, possibly producing solidification of the molten metal there. If first magnetic member 48 is relatively narrow, the magnetic field will be sufficiently concentrated in front of first magnetic member 48 to prevent the molten metal from touching refractory 80 at that location. First magnetic member 48 can be as narrow as 0.020 inches (0.508 mm) and as wide as the separation between rolls 31, 32 at the narrowest portion of gap 35 (e.g. 0.1–0.25 inches) (2.54–6.35 mm).

In FIG. 15, which shows the magnetic field at essentially the narrowest portion of gap 35, the magnetic pressure directly in front of first magnetic member 48 will be sufficiently high to prevent the molten steel from contacting refractory member 80 at that location. The increased magnetic pressure at the elevation depicted in FIG. 15 is due to the smaller magnetic path length at that elevation and the closer proximity to the front edge 49 of first magnetic member 48 of space 109 in which the magnetic field is squeezed to increase the flux density thereof.

First magnetic member 48 need not be uniform in width along its vertical dimension. However, if the width of first magnetic member 48 is varied, the minimum width should be at the bottom thereof.

Referring now to FIGS. 16–23, indicated generally at 130 (FIGS. 16–17 and 23) is an apparatus constructed in accordance with another embodiment of the present invention.

Apparatus 130 comprises a current-conducting coil 140 having a multiplicity of vertically disposed coil turns 141 wrapped around a vertically disposed magnetic member 150. Each coil turn 141 comprises a vertically disposed front portion 142 facing ope side 36 of gap 35. Alternating current is conducted through coil 140, and this directly generates a horizontal magnetic field which, because of the proximity of coil 140 to open side 36, causes the magnetic field to extend from front portions 142 of coil turns 141, through open side 36 of gap 35, to the molten metal in the gap, and with sufficient strength to exert a confining pressure against the molten metal in the gap.

Figure 17:
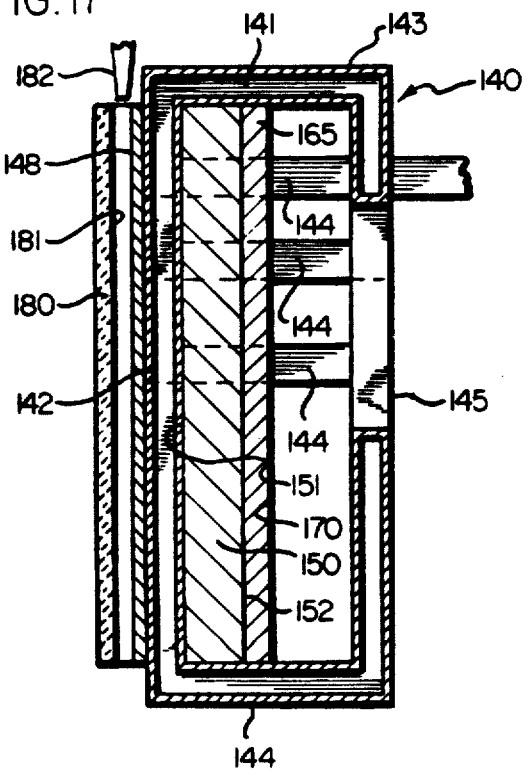
FIG. 17 is a sectional view taken along line 17—17 in FIG. 16.
Figure 23:
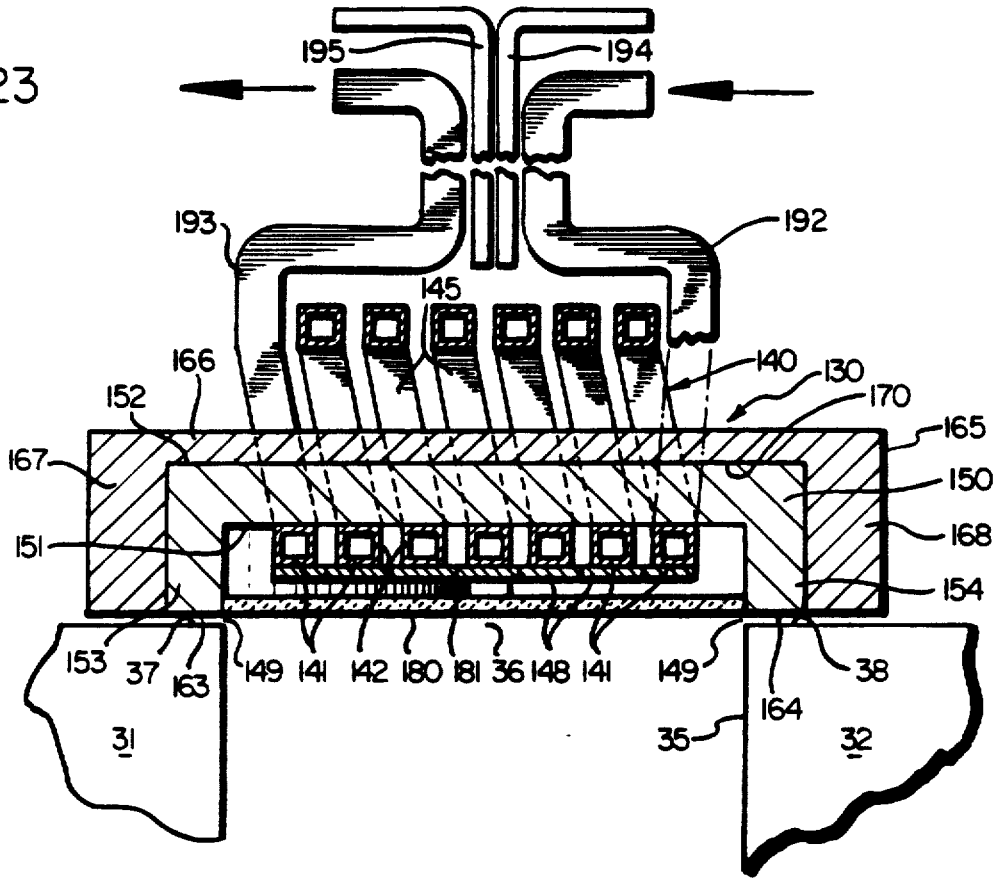
FIG. 23 is a sectional view taken along line 23—23 in FIG. 16.

Except for the coil turn 141 located furthest to the left as viewed in FIG. 23, each coil turn 141 includes a top portion 143 connected to that coil turn's front portion 142, a bottom portion 144 connected to the bottom of that coil turn's front portion 142 and a back portion 145 connecting the bottom portion 144 of a coil turn 141 to the top portion 143 of an adjacent coil turn 141 (FIG. 17). The coil turn furthest to the left, as viewed in FIG. 23, does not include a back portion. Instead, bottom portion 144 on that coil turn communicates with other structure to be subsequently described.

Coil 140 is composed of hollow copper tubing through which a cooling fluid is circulated. The cooling fluid enters coil 140 through an inlet conduit 192 connected to the top portion 143 of the coil turn 141 located furthest to the right as viewed in FIG. 23. The cooling fluid exits from coil 140 through an outlet conduit 193 connected to the bottom portion 144 of the coil turn 141 located furthest to the left in FIG. 23. A pair of bus bars 194, 195 are electrically connected respectively to inlet conduit 192 and outlet conduit 193 to conduct alternating electric current through coil 140.

Apparatus 130 comprises structure for preventing the magnetic field from dissipating in a direction away from open side 36 of gap 35. This structure restricts the magnetic field generated by coil 140 substantially to the gap's open side 36. Referring to FIGS. 16–18 and 23, conductively attached to each front portion 142 of a respective coil turn 141, and facing open side 36 of gap 35, is a vertically disposed metal strip 148 constituting a non-magnetic conductor, composed of copper, for example.

Figure 16:
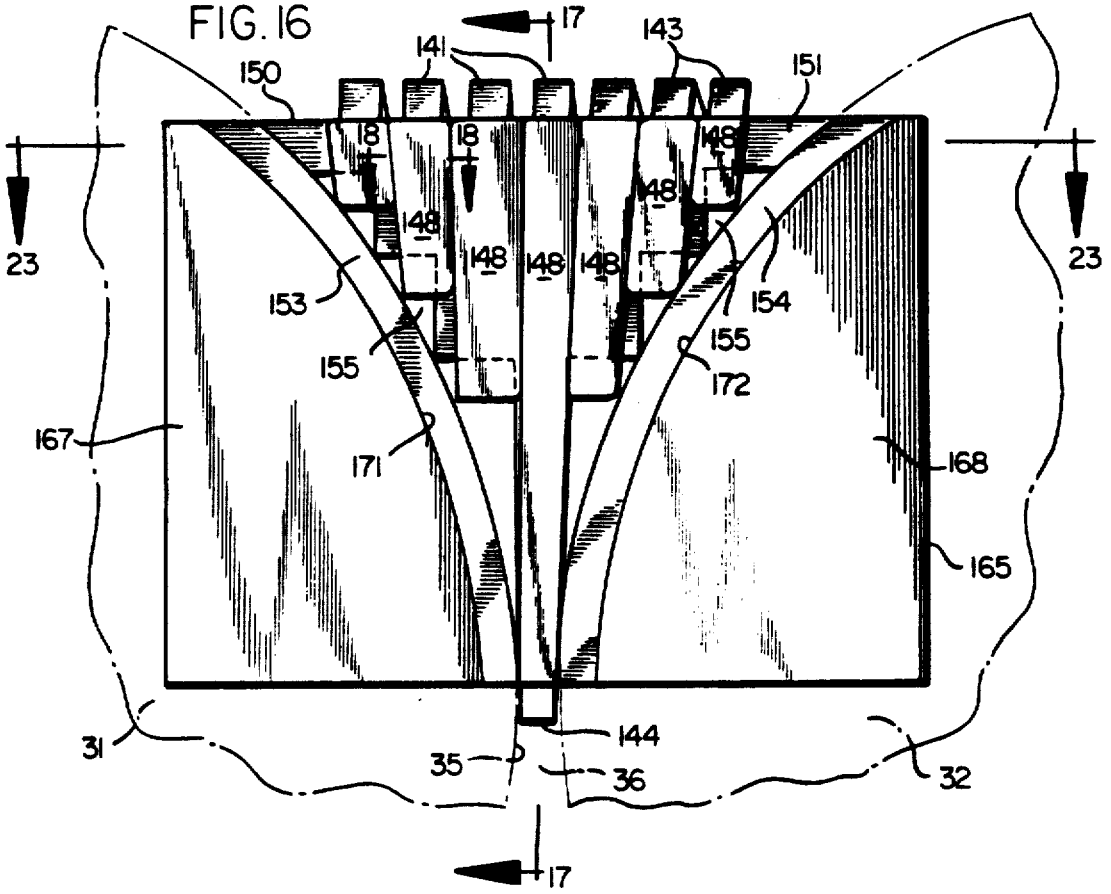
FIG. 16 is a front end view of another embodiment of apparatus in accordance with the present invention.

As shown in FIG. 16, each metal strip 148 has a width which narrc ws downwardly along the vertical dimension of the strip in conformity with a narrowing in the width of open side 36 of gap 35, so that, when current flows through coil 140 and strips 148, the current density in the strip increases with decreasing strip width. As noted above, the static pressure developed by the molten metal in gap 35 increases with increased depth. However, because increased current density produces increased magnetic pressure, the configuration of the conductor defined by strips 148 brings about an increase in magnetic pressure in conformity with the increased static pressure developed by the molten metal in gap 35.

The non-magnetic conductor defined by strips 148 and located between coil 140 and the open side of the gap, is sufficiently proximate to open side 36 to confine the magnetic field generated by coil 140 substantially to the open side of the gap. As shown in FIGS. 16 and 17, the conductor defined by strip 148 occupies substantially the entire area, at the front of the coil, between upper and lower portions 143, 144 of each coil turn 141.

Figure 18:
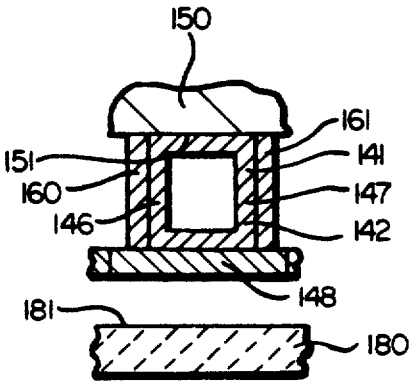
FIG. 18 is a sectional view taken along line 18—18 in FIG. 16.

Magnetic member 150 is composed of magnetic material, it is associated with coil 140, and it cooperates with the coil to produce a low reluctance return path for the directly generated magnetic field produced by coil 140 and which extends through open side 36 of gap 35. As shown in FIGS. 18 and 23, magnetic member 150 has a front surface 151 facing open side 36 of gap 35. Each front portion 142 of each coil turn 141 is located in front of front surface 151 of magnetic member 150. Each front portion 142 of a coil turn 141 has a pair of sides 146, 147 each covered by a strip of magnetic material 160, 161 respectively (FIG. 18). Each strip of magnetic material 160, 161 extends between (a) front surface 151 of magnetic member 150 and (b) metal strip 148 attached to front portion 142, to concentrate the electric current flowing through coil turn front portion 142 on metal strip 148.

There is a thin insulating film between front surface 151 of magnetic member 150 and front portion 142 of coil turn 141. Similarly, there is a thin film of electrical insulating material between each side 146, 147 of front portion 142 and the corresponding magnetic strip 160, 161 covering sides 146, 147 respectively. Strips 148 are in substantially abutting, side-by-side relation separated only by a thin film of electrical insulating material. The electrical insulating material described in the preceding paragraph is the same as that used in apparatus 30 illustrated in FIGS. 1-15 to separate coil 40 from magnetic members 48 and 50.

Magnetic member 150 and magnetic strips 160, 161 may be composed of the same magnetic material as are the magnetic members 48 and 50 in apparatus 30.

Figure 19:
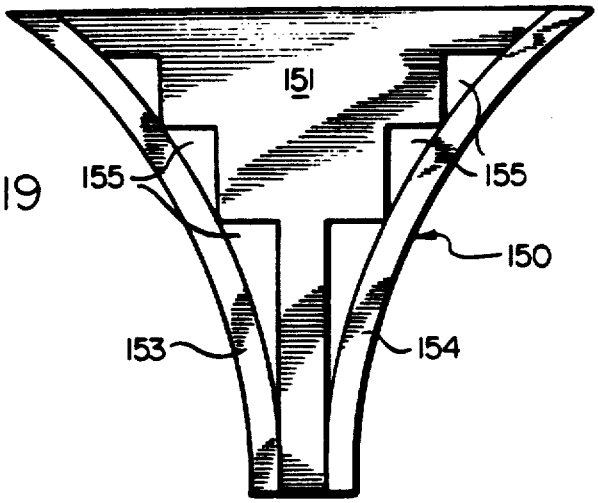
FIG. 19 is a front end view of one component of the embodiment of FIG. 16.
Figure 20:
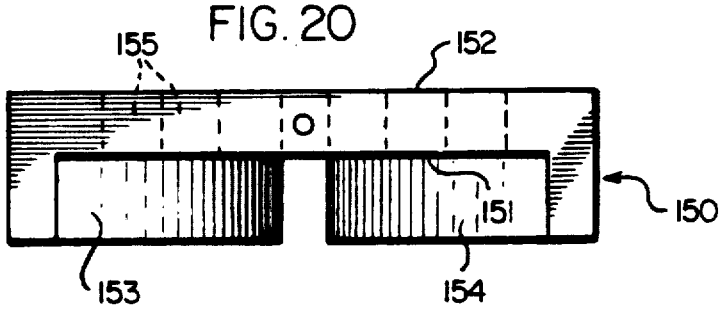
FIG. 20 is a plan view of the component of FIG. 19.

Referring to FIGS. 19 20, magnetic member 150 comprises, in addition to front surface 151, a rear surface 152, and a pair of arcuate downwardly converging sidewalls 153, 154 which conform the shape of member 150 substantially to the shape of open side 36 of gap 35. Magnetic member 150 has cut-out portions 155 (FIG. 19) adjacent each sidewall 153, 154 and through which pass the bottom portions 144 of coil turns 141. Top portions 143 of each coil turn 141 extend over the top of magnetic member 150 (FIG. 17). As shown in FIG. 17, front portion 142 of each coil turn 141 is located in front of front surface 151 of magnetic member 150, and each back portion 145 of a coil turn is located behind the rear surface 152 of magnetic member 150 and extends between the bottom portion 144 of that coil turn and the top portion 143 of an adjacent coil turn 141.

Each coil turn 141 has a vertical dimension differing from the vertical dimension of an adjacent coil turn 141 and substantially corresponding to the vertical dimension of that part of magnetic member 150 around which the coil turn is wrapped. Each vertically disposed metal strip 148 is substantially vertically coextensive with the coil front portion 142 to which strip 148 is conductively attached. Each strip 148 has a pair of side edges, and the side edges of adjacent strips 148 define a space therebetween which is insubstantial (FIG. 16) and which contains a thin film of electrical insulating material to prevent electrical shorting between adjacent strips.

Figure 21:
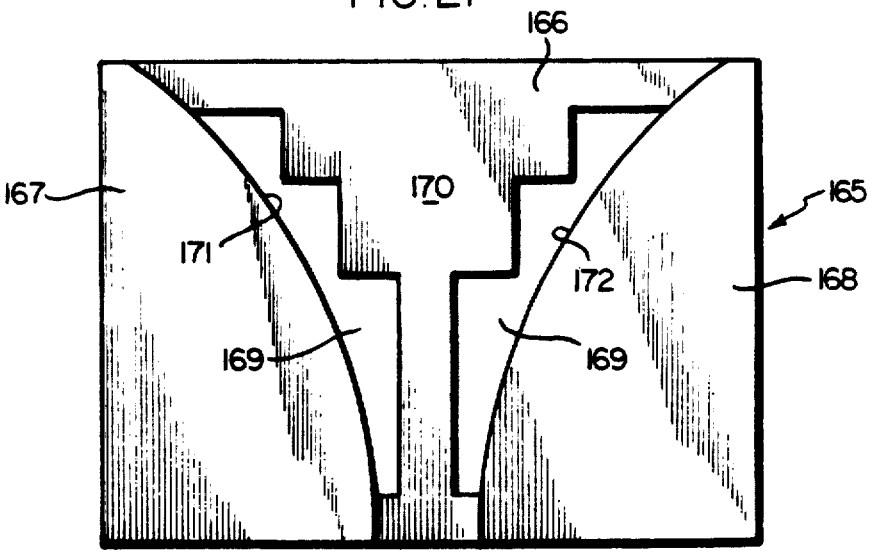
FIG. 21 is a front end view of another component of the embodiment of FIG. 16.
Figure 22:
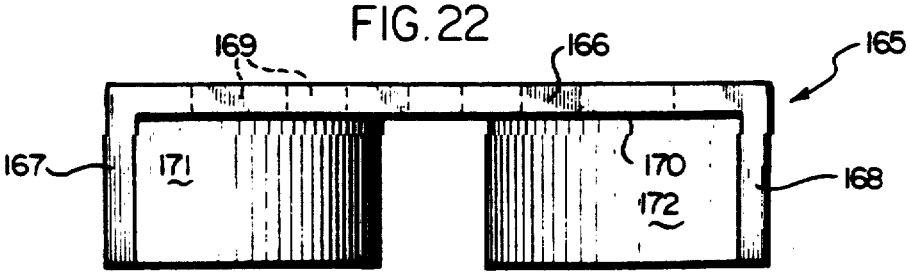
FIG. 22 is a plan view of the component of FIG. 21.

Magnetic member 150 has a width which (a) varies in a vertical direction along member 150 and (b) corresponds substantially to the width of open side 36 of gap 35 in the same horizontal plane. Surrounding magnetic member 150 is a shield 165 composed of a conducting material such as copper (FIGS. 16-17 and 23). As shown in FIGS. 21-22, shield 165 comprises a rear wall 166 and a pair of sidewalls 167, 168. Rear wall 166 is cut out at 169 to accommodate the passage through rear wall 166 of bottom portions 144 of coil turns 141. Rear wall 166 of shield 165 closely encloses rear surface 152 of magnetic member 150 and is separated therefrom by a thin film of electrical insulating material. Each sidewall 167, 168 of shield 165 has a respective downwardly converging inner surface 171, 172 which closely encloses a respective downwardly converging sidewall 153, 154 of magnetic member 150 and is separated therefrom by a thin film of electrical insulating material.

Shield 165 serves substantially the same function in apparatus 130 as does shield 65 in apparatus 30 of FIGS. 1-15.

Referring now to FIG. 23, sidewalls 153, 154 of magnetic member 150 have front ends 163, 164 respectively. Extending between these sidewalls, at their front ends, is a refractory member 180 which performs the same function in apparatus 130 as does refractory member 80 in apparatus 30, namely protecting coil 140 and strips 148 from the molten metal in gap 35, refractory member 80 being disposed between strips 148 and open side 36 of gap 35.

However, additionally in apparatus 130, there is a space 181 between refractory member 180 and strips 148. Space 181 comprises a medium through which a cooling gas can be passed, e.g. from an air knife 182 which is situated to direct a cooling gas through space 181 (FIG. 17).

The magnetic field generated by apparatus 130 extends horizontally across open side 36 of gap 35 between front ends 163, 164 of sidewalls 153, 154 on magnetic member 150. There is a space 149 between end 163 of sidewall 153 and the adjacent peripheral side edge 37 of roll 31; and there is a similar space 149 between end 164 of sidewall 154 and peripheral side edge 38 of roll 32. The magnetic field is squeezed in spaces 149 thereby increasing the magnetic flux density and magnetic pressure there compared to those existing at open side 36 of gap 35. This enhances the resistance to escape of molten metal through spaces 149.

Figures 25, 26:
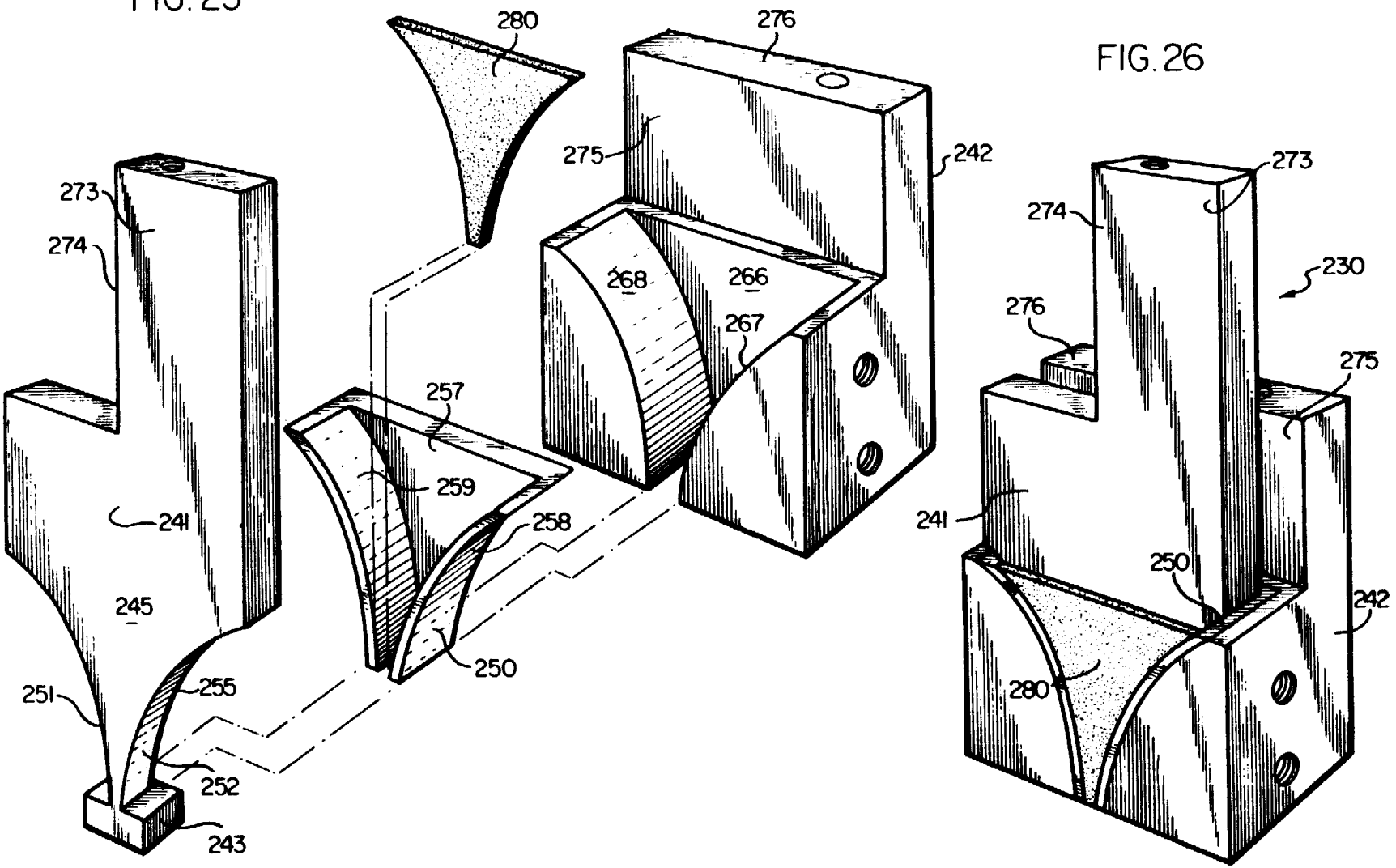
FIG. 25 is an exploded perspective of a further embodiment of an apparatus in accordance with the present invention.
FIG. 26 is a perspective of the apparatus with the components thereof assembled together.

Indicated generally at 230 in FIGS. 25-26 is another embodiment of apparatus constructed in accordance with the present invention. Apparatus 230 is positioned adjacent open side 36 of gap 35 similar to the positioning of apparatus 30, and apparatus 230 employs the proximity effect to exert a confining pressure against the molten metal in gap 35, in a manner similar to that described above in connection with apparatus 30, except for such differences as are noted below.

Apparatus 230 comprises a single turn coil 240 composed of what are substantially two half-coils comprising a front half-coil 241 connected at its bottom end by a shorting element 243 to a rear half-coil 242 which functions also as a shield, as will be subsequently described.

Alternating current flows from a bus bar (not shown) downwardly through front half-coil 241, then through shorting element 243 to rear half-coil 242, upwardly through the latter (which functions as a return path for the current) and then away from coil 240 through another bus bar (not shown) connected to half coil 242.

Front half-coil 241 has a front wall 245, constituting the front surface portion of coil 240, side walls 251, 252 and a rear wall 255. A magnetic member 250 closely encloses the front half-coil's rear wall 255 and side walls 251, 252, similar to the enclosure of corresponding walls on coil 40 by magnetic member 50 (FIGS. 4-5). A thin insulating layer (not shown) separates magnetic member 250 from half coil walls 251, 252 and 255.

The arrangement described in the preceding paragraph concentrates the current, flowing downwardly through half coil 241, on front surface portion 245 thereof.

The shield defined by rear half coil 242 has a rear wall portion 266 and side wall portions 267, 268 which closely enclose a rear wall 257 and side walls 258, 259 on magnetic member 250. A thin insulating layer (not shown) separates the wall portions of the shield from the walls of the magnetic member.

Coil 240 directly generates a magnetic field which is disposed horizontally and substantially uniformly across the full horizontal width of front surface portion 245 of half coil 241 and through the open side 36 of gap 35. Front surface portion 245 is a non-magnetic electrical conductor which faces the gap's open side 36 and is positioned sufficiently proximate to open side 36 to confine the magnetic field substantially to the gap's open side.

Magnetic member 250 comprises a low reluctance return path for the directly generated magnetic field which extends through the gap's open side. Shield 242 confines that part of the directly generated magnetic field which is outside of the low reluctance return path substantially to a space defined on one side by front surface portion 245 of half coil 241 and on the other side by the molten metal in gap 35.

A refractory member 280 cooperates with the other components of apparatus 230 in the same manner as refractory member 80 cooperates with the components of apparatus 30. Refractory member 280 functions like refractory member 80.

Apparatus 230 differs from apparatus 30 principally in that apparatus 230 eliminates the gap in the horizontal magnetic field generated by apparatus 30 and resulting from the location of first magnetic member 48 between half coils 41 and 42 (FIG. 14). Apparatus 230 provides a magnetic field which is disposed fully across front surface portion 245 of coil 240 and which has a more uniform horizontal component than the magnetic field generated by apparatus 30. Because of this greater uniformity, the magnetic field will tend to penetrate further into gap 35, although apparatus 230 requires twice the current flow required by apparatus 30.

Half coil 241 has a vertical extension 273 for attachment, e.g. at 274, to a bus bar to supply incoming current to half coil 241. Half coil 242 has an upper portion 275 for attachment, e.g. at 276, to a bus bar for return flow of current away from half coil 242. Components 241-243, 273 and 275 are hollow. Cooling fluid is circulated through half coils 241 and 242, through shorting member 243, through extension 273 on half coil 241 and through upper portion 275 on half coil 242. Appropriate guide members and passages for the cooling fluid are provided within all of the components described in the preceding paragraph, these being structural expedients which are within the skill of the art.

Apparatus 230 is easier to cool than apparatus 30 because apparatus 230 does not employ a magnetic member like first magnetic member 48 employed in apparatus 30. First magnetic member 48, composed of iron laminates and located in a slot between half coils 41 and 42, renders apparatus 30 relatively more difficult to cool.

The foregoing detailed description has been given for clearness of understanding only, and no unnecessary limitations should be understood therefrom, as modifications will be obvious to those skilled in the art.

We claim:

1. A magnetic confining apparatus employing the proximity effect for preventing the escape of molten metal through the open side of a vertically extending gap between two horizontally spaced members and between which said molten metal is located, said apparatus comprising:

electrically conductive coil means, adjacent the open side of said gap, for directly generating a horizontal magnetic field which extends through the open side of said gap to said molten metal;

said coil means being sufficiently proximate to said open side of the gap so that said directly generated horizontal magnetic field has a strength sufficient to exert a confining pressure against the molten metal in the gap;

said coil means having a surface portion facing the open side of said gap;

magnetic means, associated with said coil means, and comprising means for concentrating the flow of electric current in said surface portion of the coil means which faces the open side of the gap;

and non-magnetic, electrical conductor means in electrically conductive relation with said surface portion;

said non-magnetic, electrical conductor means facing said open side of the gap and comprising means sufficiently proximate to said open side of the gap to confine said magnetic field substantially to said open side of the gap.

2. An apparatus as recited in claim 1 wherein:

said open side of the gap lies in a vertical plane;

and said conductor means is disposed in substantially parallel relation to said open side of the gap.

3. An apparatus as recited in claim 2 wherein:

said coil means has an upper portion and a lower portion;

and said conductor means occupies substantially the entire area between the upper and lower portions of said coil means.

4. An apparatus as recited in claim 1 wherein:

said magnetic means comprises a low reluctance return path for said directly generated magnetic field which extends through the open side of said gap.

5. An apparatus as recited in claim 4 and comprising:

an electrically conductive shield comprising means for confining that part of said directly generated magnetic field, which is outside of said low reluctance return path, to substantially a space defined on one side by said surface portion of the coil means and on the other side by said molten metal.

6. An apparatus as recited in claim 4 wherein said two horizontally disposed members are rotatable rolls having parallel axes and wherein:

said magnetic means comprises a vertically disposed magnetic member associated with said coil means;

said coil means comprises a multiplicity of vertically disposed coil turns wrapped around said magnetic member;

each coil turn comprising a vertically disposed front portion facing said open side of the gap;

and said non-magnetic conductor means comprises a multiplicity of vertically disposed metal strips each conductively attached to the front portion of a respective coil turn and each facing the open side of the gap;

each metal strip having a width which narrows downwardly along the vertical dimension of said strip in conformity with a narrowing in the width of said open side of the gap, so that, when current flows through said coil means and said strip, the current density in said strip increases with decreasing strip width.

7. An apparatus as recited in claim 6 wherein:

said magnetic member has a front surface facing the open side of the gap;

said front portion of each coil turn is located in front of the front surface of the magnetic member;

each front portion of a coil turn has a pair of sides each covered by a strip of magnetic material extending between (a) the front surface of the magnetic member and (b) the metal strip attached to said front portion of the coil turn, to concentrate the electric current flowing through said front portion on said metal strip.

8. An apparatus as recited in claim 7 wherein:

said coil means comprises a tube through which a cooling fluid can be circulated.

9. An apparatus as recited in claim 8 wherein:

said magnetic member has a rear surface, and a pair of downwardly substantially converging side walls which conform the shape of said member substantially to the shape of said open side of the gap;

each coil turn has top and bottom portions connected to said front portion of the coil turn;

the front portion of each coil turn is located in front of the front surface of the magnetic member;

and a plurality of said coil turns have a rear portion located behind the rear surface of the magnetic member and extending between the bottom portion of that coil turn and the top portion of an adjacent coil turn.

10. An apparatus as recited in claim 9 wherein:

each coil turn has a vertical dimension differing from the vertical dimension of adjacent coil turns and substantially corresponding to the vertical dimension of that part of the magnetic member around which said coil turn is wrapped.

11. An apparatus as recited in claim 10 wherein:

each vertically disposed metal strip is substantially vertically coextensive with the coil front portion to which the strip is conductively attached.

each strip has a pair of side edges;

and the side edges of adjacent strips define a space therebetween which is insubstantial.

12. An apparatus as recited in claim 11 wherein:

said space between side edges of adjacent strips is electrically insulated.

13. An apparatus as recited in claim 8 wherein:

said magnetic member has a width (a) which varies in a vertical direction along the member and (b) which substantially corresponds to the width of the open side of the gap in the same horizontal plane.

14. An apparatus as recited in claim 7 and comprising:

a refractory member disposed between said conductor means and the open side of the gap.

15. An apparatus as recited in claim 14 and comprising:

a space between said refractory member and said conductor means;

said space comprising means through which a cooling gas can be passed;

and means for directing a cooling gas through said space.

16. An apparatus as recited in claim 5 wherein:

said surface portion of the coil means and said electrical conductor means coincide.

17. An apparatus as recited in claim 16 wherein:

said coil means comprises a single-turn coil;

each of said apart members has (a) a side edge defining an edge of said open side of the gap and (b) a side edge portion adjacent said side edge;

said conductor means has (a) a pair of horizontally spaced outside edges and (b) an outside edge portion adjacent each outside edge;

the horizontal distance between the two outside edges on said conductor means is greater than the horizontal distance between said two side edges defining the open side of said gap, at the same vertical location along said gap;

each outside edge portion on said conductor means is spaced away from a respective side edge portion of a member to define a narrow space therebetween;

said outside edge portion on the conductor means and said side edge portion on the member comprise means cooperating to provide an increased magnetic flux density in the magnetic field in said narrow space, compared to the flux density of the magnetic field extending across said open side of the gap, thereby preventing molten metal from flowing laterally outwardly through said narrow space.

18. An apparatus as recited in claim 17 wherein:

said molten metal is molten steel;

and said conductor means and at least said edge portions of said members are composed of copper or copper alloy.

19. An apparatus as recited in claim 16 wherein said coil means and said conductor means are each composed of copper or copper base alloy.

20. An apparatus as recited in claim 16 wherein said two horizontally spaced members are rotatable rolls having parallel axes and wherein:

said coil means comprises a single coil turn;

and said magnetic means comprises a vertically disposed substantially planar, first magnetic member which (a) lies in a plane which is parallel to the axes of said rolls and (b) has a pair of opposite side surfaces;

said coil turn having a pair of vertically disposed, substantially half-coils each located adjacent a respective opposite side surface of said magnetic member and electrically insulated therefrom;

each half-coil having a vertically disposed front wall facing the open side of said gap;

the two front walls of said two half-coils constituting said electrical conductor means 21. An apparatus as recited in claim 20 wherein:

each front wall of a half-coil has a width which narrows downwardly along the vertical dimension of said half-coil in conformity with a narrowing in the width of said open side of the gap, so that, when current flows through said coil, the current density in said front wall increases with decreasing width of the front wall.

22. An apparatus as recited in claim 21 wherein:

the conductor means defined by said two front walls has a shape conforming substantially to the shape of the open side of said gap.

23. An apparatus as recited in claim 21 wherein:

each half-coil has an outside wall, an inside wall and a rear wall each extending between upper and lower ends of the half-coil.

24. An apparatus as recited in claim 23 wherein:

said coil comprises means conductively connecting said two half-coils adjacent an end of each.

25. An apparatus as recited in claim 22 or claim 24 wherein:

said coil has a hollow interior defining a passage through which a cooling fluid may be circulated.

26. An apparatus as recited in claim 23 wherein said magnetic means further comprises:

a second magnetic member having a rear wall, enclosing the rear wall of both half-coils and electrically insulated therefrom, and a pair of spaced-apart sidewalls each enclosing the outside wall of a respective half-coil and electrically insulated therefrom.

27. An apparatus as recited in claim 26 wherein:

said first magnetic member has a front edge, facing said open side of the gap in substantially the same close proximity thereto as said conductor means, and a rear edge in substantially abutting relation with the rear wall of said second magnetic member;

each sidewall of said second magnetic member having a front end facing a respective rotatable roll adjacent said peripheral side edge of the roll;

said first magnetic member and said second magnetic member comprising means cooperating to produce said low reluctance return path.

28. An apparatus as recited in claim 27 wherein:

said shield has a rear wall portion, enclosing the rear wall of said second magnetic member from behind and electrically insulated therefrom, and a pair of sidewall portions each enclosing a respective sidewall of said second magnetic member from the outside and electrically insulated therefrom.

29. An apparatus as recited in claim 28 wherein:

each side wall portion of said shield has an inner surface which (a) is in close proximate relation to the adjacent side wall of said second magnetic member and (b) follows the contour of said adjacent side wall;

and said rear wall portion of the shield has an inner surface in close proximate relation to the rear wall of said second magnetic member.

30. An apparatus as recited in claim 29 wherein:

said shield has a hollow interior defining a passage through which a cooling fluid can be circulated.

31. An apparatus as recited in claim 29 wherein:

each sidewall of the second magnetic member is in close proximate relation with the outside wall of a respective half-coil and follows the contour of that outside wall.

32. An apparatus as recited in claim 31 wherein:

the conductor means defined by said two front walls has a shape conforming substantially to the shape of the open side of said gap;

each front wall having a respective outside edge and an outside edge portion adjacent said outside edge.

33. An apparatus as recited in claims 27 or 28 wherein said apparatus further comprises:

a refractory member covering the front edge of said first magnetic member and the front wall of each half-coil.

34. An apparatus as recited in claim 33 wherein:

said refractory member has a pair of opposed side edges each abutting against a respective sidewall of the second magnetic member.

35. An apparatus as recited in claim 34 wherein:

said refractory member has a vertically disposed outside surface; and said outside surface and each front end of a sidewall on the second magnetic member lie in substantially the same vertical plane.

36. An apparatus as recited in claim 20 wherein:

said first magnetic member has a lower portion at substantially the same vertical level as the narrowest part of said open side of the gap;

said lower portion being composed of a plurality of horizontally disposed, vertically layered strips of grain oriented silicon steel.

37. An apparatus as recited in claim 16 and comprising:

means, including the configuration of said conductor means, for increasing the magnetic pressure associated with said magnetic field in conformity with increasing static pressure of the molten metal in said gap.

38. An apparatus as recited in claim 16 wherein said two horizontally spaced members are rotatable rolls having parallel axes and peripheral side edges defining the open side of said gap and wherein:

said coil means comprises a single-turn coil having a pair of vertically disposed, substantially half-coils;

a first of said half-coils having a vertically disposed front wall facing the open side of said gap and constituting said electrical conductor means;

the second of said half-coils being located behind said one half-coil and being more remote from said open side of the gap than said one half-coil.

39. An apparatus as recited in claim 38 wherein:

said front wall of said first half-coil has a width which narrows downwardly along the vertical dimension of said half-coil in conformity with a narrowing in the width of said open side of the gap, so that, when current flows through said coil, the current density in said front wall increases with decreasing width of the front wall.

40. An apparatus as recited in claim 39 wherein:

the conductor means defined by said front wall has a shape conforming substantially to the shape of the open side of said gap.

41. An apparatus as recited in claim 38 wherein:

said first half-coil has a pair of side walls and a rear wall each extending between upper and lower ends of the half-coil.

42. An apparatus as recited in claim 41 wherein:

said coil comprises means conductively connecting said two half-coils adjacent an end of each.

43. An apparatus as recited in claim 39 or claim 42 wherein:

at least said first half-coil has a hollow interior defining a passage through which a cooling fluid may be circulated.

44. An apparatus as recited in claim 41 wherein said magnetic means comprises:

a magnetic member having a rear wall, enclosing the rear wall of the first half-coil and electrically insulated therefrom, and a pair of spaced-apart sidewalls each enclosing a respective side wall of the first half-coil and electrically insulated therefrom.

45. An apparatus as recited in claim 44 wherein:

each sidewall of said magnetic member has a front end facing a respective rotatable roll adjacent said peripheral side edge of the roll.

46. An apparatus as recited in claim 45 wherein:

said shield has a rear wall portion, enclosing the rear wall of said magnetic member from behind and electrically insulated therefrom, and a pair of sidewall portions each enclosing a respective sidewall of said magnetic member from the outside and electrically insulated therefrom.

47. An apparatus as recited in claim 46 wherein:

each side wall portion of said shield has an inner surface which (a) is in close proximate relation to the adjacent side wall of said magnetic member and (b) follows the contour of said adjacent side wall;

and said rear wall portion of the shield has an inner surface in close proximate relation to the rear wall of said magnetic member.

48. An apparatus as recited in claim 47 wherein:

said shield has a hollow interior defining a passage through which a cooling fluid can be circulated.

49. An apparatus as recited in claim 47 wherein:

each sidewall of the magnetic member is in close proximate relation with a respective sidewall of the first half-coil and follows the contour of that sidewall of the first half-coil.

50. An apparatus as recited in claim 49 wherein:

the conductor means defined by the front wall of the first half-coil has a shape conforming substantially to the shape of the open side of said gap.

51. An apparatus as recited in claim 45 or claim 46 wherein said apparatus further comprises:

a refractory member covering the front wall of said first half-coil.

52. An apparatus as recited in claim 51 wherein:

said refractory member has a pair of opposed side edges each abutting against a respective sidewall of the magnetic member.

53. An apparatus as recited in claim 52 wherein:

said refractory member has a vertically disposed outside surface; and said outside surface and each front end of a sidewall on the magnetic member lie in substantially the same vertical plane.

54. A magnetic confining method employing the proximity effect for preventing the escape of molten metal through the open side of a vertically extending gap between two horizontally spaced members and between which said molten metal is located, said method comprising the steps of:

directly generating, at a location adjacent the open side of said gap, a horizontal magnetic field which extends through the open side of said gap to said molten metal;

generating said horizontal magnetic field sufficiently proximate to said open side of the gap so that said directly generated horizontal magnetic field has a strength sufficient to exert a confining pressure against the molten metal in said gap;

confining said magnetic field to said open side of the gap.; and providing a low reluctance return path, composed of magnetic material, for said directly generated magnetic field which extends through said open side of the gap.

55. A method as recited in claim 54 wherein said generating step comprises:

providing a current-conducting coil adjacent the open side of said gap with a coil surface portion facing said open side of the gap;

conducting electric current through said coil to directly generate said horizontal magnetic field;

and concentrating the flow of electric current in that surface portion of the coil which faces the open side of said gap.

56. A method as recited in claim 55 and comprising:

confining that part of said directly generated magnetic field, which is outside of said low reluctance return path, to substantially a space defined on one side by said coil surface portion and on the other side by said molten metal.

57. A method as recited in claim 56 and comprising:

increasing the magnetic pressure associated with said magnetic field in conformity with increasing static pressure of the molten metal in said gap.

58. A magnetic confining apparatus for preventing the escape of molten metal through the open side of a vertically extending gap between two horizontally spaced members and between which said molten metal is located, said apparatus comprising:

electrically conductive coil means, adjacent the open side of said gap, for generating a horizontal magnetic field which extends through the open side of said gap to said molten metal and exerts a confining pressure against the molten metal in the gap;

said coil means having a surface portion facing the open side of said gap;

magnetic means, associated with said coil means, and comprising means for concentrating the flow of electric current in said surface portion of the coil means which faces the open side of the gap;

and surface portion of said coil means comprising non-magnetic, electrical conductor means facing said open side of the gap;

said non-magnetic, electrical conductor means comprising means sufficiently proximate to said open side of the gap to confine said magnetic field to said open side of the gap.

59. An apparatus as recited in claim 58 wherein:

said open side of the gap lies in a vertical plane;

and said conductor means is disposed in substantially parallel relation to said open side of the gap.

60. An apparatus as recited in claim 58 wherein:

said magnetic means comprises a low reluctance return path for said directly generated magnetic field which extends through the open side of said gap.

61. An apparatus as recited in claim 60 and comprising:

an electrically conductive shield comprising means for confining that part of said magnetic field, which is outside of said low reluctance return path, to substantially a space defined on one side by said non-magnetic, electrical conductor means and on the other side by said molten metal.

62. An apparatus as recited in claim 58 or claim 61 wherein:

said coil means comprises a single-turn coil;

each of said apart members has (a) a side edge defining an edge of said open side of the gap and (b) a side edge portion adjacent said side edge;

said conductor means has (a) a pair of horizontally spaced outside edges and (b) an outside edge portion adjacent each outside edge;

the horizontal distance between the two outside edges on said conductor means is greater than the horizontal distance between said two side edges defining the open side of said gap, at the same vertical location along said gap;

each outside edge portion on said conductor means is spaced away from a respective side edge portion of a member to define a narrow space therebetween;

said outside edge portion on the conductor means and said side edge portion on the member comprise means for cooperating to provide an increased magnetic flux density in the magnetic field in said narrow space, compared to the flux density of the magnetic field extending across said open side of the gap, thereby preventing molten metal from flowing laterally outwardly through said narrow space.

63. An apparatus as recited in claim 61 wherein:
said molten metal is molten steel;
and said conductor means is composed of copper or copper alloy.

64. An apparatus as recited in claim 61 wherein:
said coil means and said conductor means are each composed of copper or copper base alloy.

65. An apparatus as recited in claim 58 or claim 61 and comprising:
means, including the configuration of said conductor means, for increasing the magnetic pressure associated with said magnetic field in conformity with increasing static pressure of the molten metal in said gap.

66. An apparatus as recited in claim 58 or claim 61 wherein said two horizontally spaced members are rotatable rolls having parallel axes and peripheral side edges defining the open side of said gap and wherein:
said coil means comprises a single-turn coil having a pair of vertically disposed, substantially half-coils;
a first of said half-coils having a vertically disposed front wall facing the open side of said gap and constituting said electrical conductor means;
the second of said half-coils being located behind said one half-coil and being more remote from said open side of the gap than said one half-coil.

67. An apparatus as recited in claim 66 wherein:
said front wall of said first half-coil has a width which narrows downwardly along the vertical dimension of said half-coil in conformity with a narrowing in the width of said open side of the gap, so that, when current flows through said coil, the current density in said front wall increases with decreasing width of the front wall.

68. An apparatus as recited in claim 67 wherein:
the conductor means defined by the front wall has a shape conforming substantially to the shape of the open side of said gap.

69. An apparatus as recited in claim 66 wherein:
said first half-coil has a pair of side walls and a rear wall each extending between upper and lower ends of the half-coil.

70. An apparatus as recited in claim 69 wherein:
said coil comprises means conductively connecting said two half-coils adjacent an end of each.

71. An apparatus as recited in claim 69 wherein:
at least said first half-coil has a hollow interior defining a passage through which a cooling fluid may be circulated.

72. An apparatus as recited in claim 69 wherein said magnetic means comprises:
a magnetic member having a rear wall, enclosing the rear wall of the first half-coil and electrically insulated therefrom, and a pair of spaced-apart sidewalls each enclosing a respective side wall of the first half-coil and electrically insulated therefrom.

73. An apparatus as recited in claim 72 wherein:
each sidewall of said magnetic member has a front end facing a respective rotatable roll adjacent said peripheral side edge of the roll.

74. An apparatus as recited in claim 73 through its dependency from claim 63 wherein:
said shield has a rear wall portion, enclosing the rear wall of said magnetic member from behind and electrically insulated therefrom, and a pair of sidewall portions each enclosing a respective sidewall of said magnetic member from the outside and electrically insulated therefrom.

75. An apparatus as recited in claim 74 wherein:
each side wall portion of said shield has an inner surface which (a) is in close proximate relation to the adjacent side wall of said magnetic member and (b) follows the contour of said adjacent side wall;
and said rear wall portion of the shield has an inner surface in close proximate relation to the rear wall of said magnetic member.

76. An apparatus as recited in claim 75 wherein:
each sidewall of the magnetic member is in close proximate relation with a respective sidewall of the first half-coil and follows the contour of that sidewall of the first half-coil.

77. An apparatus as recited in claim 76 wherein:
the conductor means defined by the front wall of the first half-coil has a shape conforming substantially to the shape of the open side of said gap.

78. An apparatus as recited in claim 74 wherein said apparatus further comprises:
refractory means covering the front wall of said first half-coil.

79. A magnetic confining method for preventing the escape of molten metal through the open side of a vertically extending gap between two horizontally spaced members and between which said molten metal is located, said method comprising the steps of:
providing a current-conducting coil adjacent the open side of said gap, with a surface portion of the coil facing said open side of the gap;
conducting electric current through said coil to generate a horizontal magnetic field which extends through the open side of said gap to said molten metal and exerts a confining pressure against the molten metal in said gap;
associating the magnetic means with said coil so as to concentrate the flow of electric current in said surface portion of the coil facing the open side of said gap.
confining said magnetic field substantially to said open side of the gap;
and providing a low reluctance return path, composed of magnetic material, for said magnetic field which extends through said open side of the gap.

80. A method as recited in claim 79 and comprising:
confining that part of said magnetic field, which is outside of said low reluctance return path, to substantially a space defined on one side by said surface portion of the coil and on the other side by said molten metal.

81. A method as recited in claim 80 and comprising:
increasing the magnetic pressure associated with said magnetic field in conformity with increasing static pressure of the molten metal in said gap.

* * * * *

UNITED STATES PATENT AND TRADEMARK OFFICE

CERTIFICATE OF CORRECTION

PATENT NO. : 5,197,534

DATED : March 30, 1993

INVENTOR(S) : Howard L. Gerber and Richard T. Gass

It is certified that error appears in the above-indentified patent and that said Letters Patent is hereby corrected as shown below:

Col. 6, line 6, after "a", add --pair of opposite side surfaces 71, 72 (Fig. 15). Each Col. 6, line 12, "sam" should be --same--.

Col. 11, line 62, "ope" should be --open--.

Col. 12, line 36, "narrcws" should be --narrows--.

IN THE CLAIMS

Col. 22, line 16, before "magnetic" add --and--.

Col. 22, line 20, "and" should be --said--.

Col. 22, line 25, after "field" add --substantially--.

Col. 22, line 46, after "each" add --spaced--.

Col. 24, line 43, after "associating" delete --the--.

Signed and Sealed this

Tenth Day of December, 1996

*Attest:*

*Attesting Officer*

Bruce Lehman

BRUCE LEHMAN

*Commissioner of Patents and Trademarks*